US007537553B2

(12) United States Patent
Mongelluzzo et al.

(10) Patent No.: US 7,537,553 B2
(45) Date of Patent: May 26, 2009

(54) OFFICE AND DESK EXERCISE CHAIR SYSTEM

(76) Inventors: Ron Mongelluzzo, 19 Gardners La., Hampton Bays, NY (US) 11946; Michael Mongelluzzo, 245 Springville Rd., Hampton Bays, NY (US) 11946

( * ) Notice: Subject to any disclaimer, the term of this patent is extended or adjusted under 35 U.S.C. 154(b) by 0 days.

(21) Appl. No.: 11/710,066

(22) Filed: Feb. 23, 2007

(65) Prior Publication Data

US 2008/0203776 A1 Aug. 28, 2008

(51) Int. Cl.
*A63B 21/04* (2006.01)
*A63B 21/02* (2006.01)

(52) U.S. Cl. ..... 482/130; 482/121; 482/904

(58) Field of Classification Search ..... 482/129–130, 482/126, 904, 148, 142, 121
See application file for complete search history.

(56) References Cited

U.S. PATENT DOCUMENTS 5,599,260 A * 2/1997 Rovinsky et al. ..... 482/121
5,755,650 A * 5/1998 Urso ..... 482/138
5,921,900 A * 7/1999 Mankovitz ..... 482/121
6,099,445 A * 8/2000 Rovinsky et al. ..... 482/121
6,386,636 B2 * 5/2002 Caruso et al. ..... 297/353
7,137,935 B2 * 11/2006 Clarke et al. ..... 482/123
7,223,220 B2 * 5/2007 Bendavid et al. ..... 482/130
2006/0052224 A1 * 3/2006 Kellogg ..... 482/130

FOREIGN PATENT DOCUMENTS

JP S57-062961 U 4/1982
KR 10-2006-0027454 A 3/2006

* cited by examiner

*Primary Examiner*—Fenn C Mathew
(74) *Attorney, Agent, or Firm*—Keusey, Tutunjian & Bitetto, P.C.

(57) ABSTRACT

An exercise apparatus is provided having a mobile desk chair including a seat with at least two arm attachment members. A back rest is provided pivotally attached to the seat. A base is provided connected to the seat, the base including a center post and a plurality of chair supports, wherein at least one of the back rest, seat, arm attachment members and chair supports includes at least one attachment point.

16 Claims, 34 Drawing Sheets

OFFICE AND DESK EXERCISE CHAIR SYSTEM

BACKGROUND OF THE INVENTION

1. Technical Field of the Invention

The present invention generally relates to exercise devices, and, more particularly, to a multi-configuration dual purpose exercise chair system for providing at least strength and flexibility training as well as office and desk chair functionality and method for operating same.

2. Description of Related Art

There exists today a wide range of exercise devices designed for home and/or gym use for providing resistance training of various muscles. Typically, such exercise apparatus for resistance training comprise heavy equipment such as weightlifting benches, circuit training machines, and the like, situated in a stationary position and not intended to be mobile during use.

While many exercise machines may be helpful in developing overall physical fitness in general, the positive benefits from such machines can only be attained through their regular usage. Convenience is an oft cited factor in determining whether a user actually utilizes an exercise device on a consistent basis to perform the exercises. In the home environment, space requirements often preclude the ability to have exercise/strength training equipment at home. Accessing gym equipment requires a membership fee and additional time spent commuting to and from the gym.

Indeed, the majority of the day for many people is often spent in a sitting position, e.g., at work in an office environment. When breaks are taken, any physical activity is often limited to mild aerobic activity such as walking, e.g., to and from lunch, or taking the stairs. Even if a person is a member of a gym, the inconvenience of traveling, changing clothes, etc. as well as time limits on breaks during work hours and unexpected schedule changes often precludes the person from attending the gym on a regular basis.

When a person is at home, the demands of attending to personal and family activities often results in the person skipping exercising due to lack of time. For many working people, free time often arises only on weekends and thus the typical working person manages to find time to exercise only on a sporadic and infrequent basis.

It is often a goal of many exercisers to incorporate resistance training in their workouts to improve strength and muscle development. However, strength training often requires access to specialized exercise and training equipment, which is often difficult to do on a consistent basis for many people for many of the reasons mentioned above.

Accordingly, a need exists for a system and method for efficiently and effectively providing resistance training and exercise for a user in a manner which optimizes convenience and maximizes the likelihood for regular use by a user.

SUMMARY OF THE INVENTION

The present invention generally relates to exercise devices, and, more particularly, to an isotonic exercise system incorporated into an ergonomic desk or task chair for providing exercise training and stress relief for a user with optimal convenience.

The present invention comprises a multi-purpose exercise training system and office chair which provides comprehensive physical fitness and therapeutic stress-relief benefits and is especially useful and convenient for the general fitness consumer. The need for heavy and dangerous weights and space-consuming specialized equipment is avoided. For example, the present invention provides an effective and efficient exercise apparatus embodied in an ergonomic and mobile desk chair directed towards strengthening a wide variety of muscle groups. Each exercise may be customized to various resistance levels and may also be adapted according to the height, weight, dimensions, flexibility, etc., of each user.

According to one embodiment, an exercise apparatus is provided comprising a mobile task chair including a seat including at least two arm attachment members and a back rest pivotally attached to the seat. A base is provided connected to the seat comprising a center post and a plurality of chair supports, wherein at least one of the back rest, seat, arm attachment members and chair supports includes at least one attachment point configured to receive an exercise implement.

According to another embodiment, a mobile exercise chair is provided comprising a back rest pivotally attached to a seat, and a base connected to the seat including a plurality of chair supports, wherein at least one of the back rest and at least one of the chair supports includes at least one attachment point configured for removable and adjustable attachment of exercise implements.

According to yet another embodiment, a mobile exercise chair is provided comprising a seat including at least two arm attachment members and a back rest pivotally attached to the seat. A base is provided connected to the seat, the base including a plurality of chair supports, wherein at least one of the arm attachment members, back rest, and at least one of the chair supports includes at least one attachment point. An exercise implement is provided having at least one end removably attached to at least one of the attachment points.

BRIEF DESCRIPTION OF THE DRAWINGS

In the drawings, wherein like reference numerals denote similar elements throughout the views.

Figure 1:
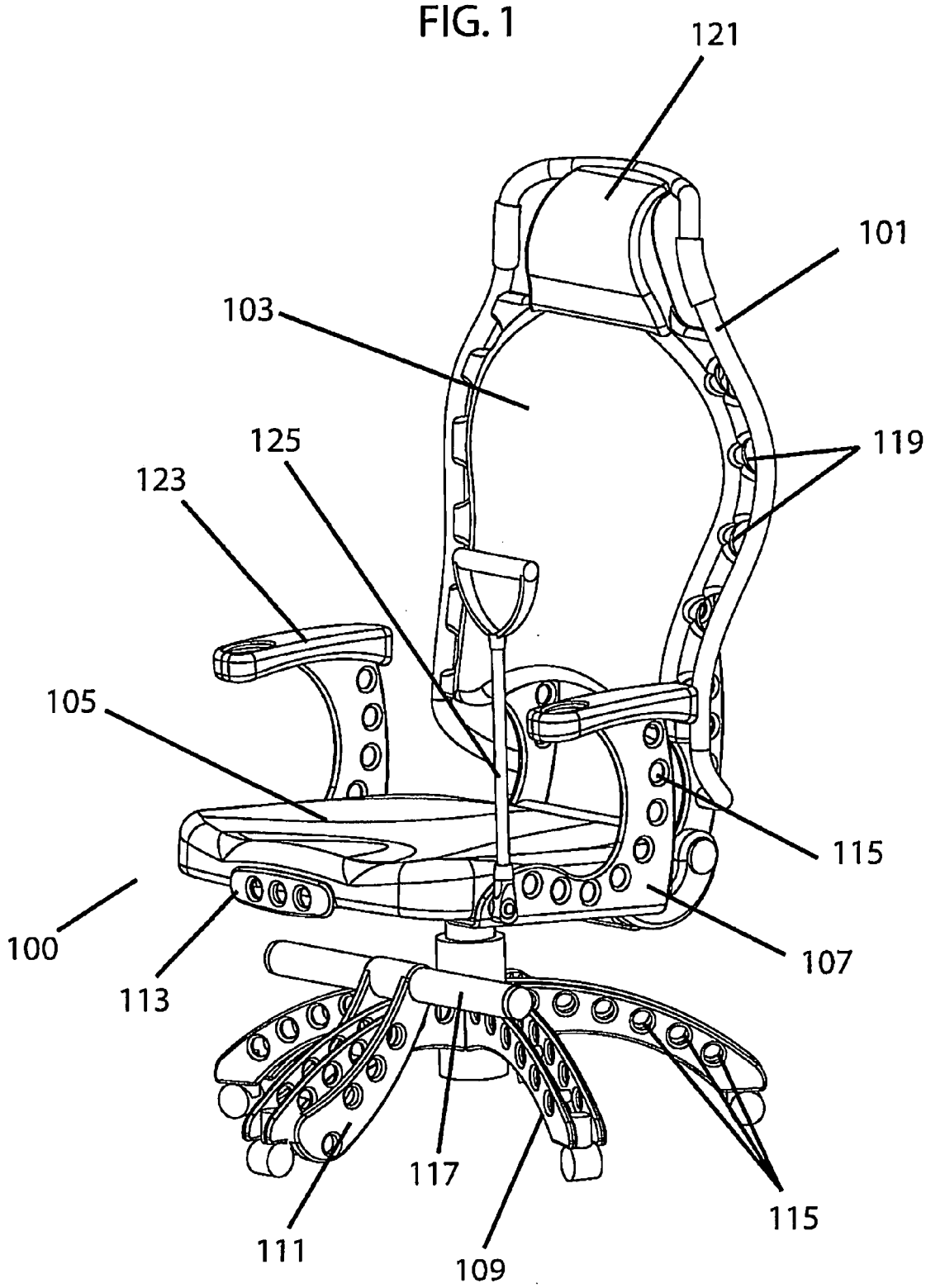
FIG. 1 is an exemplary front perspective view of an exercise chair system according to an aspect of the present invention.
Figure 2:
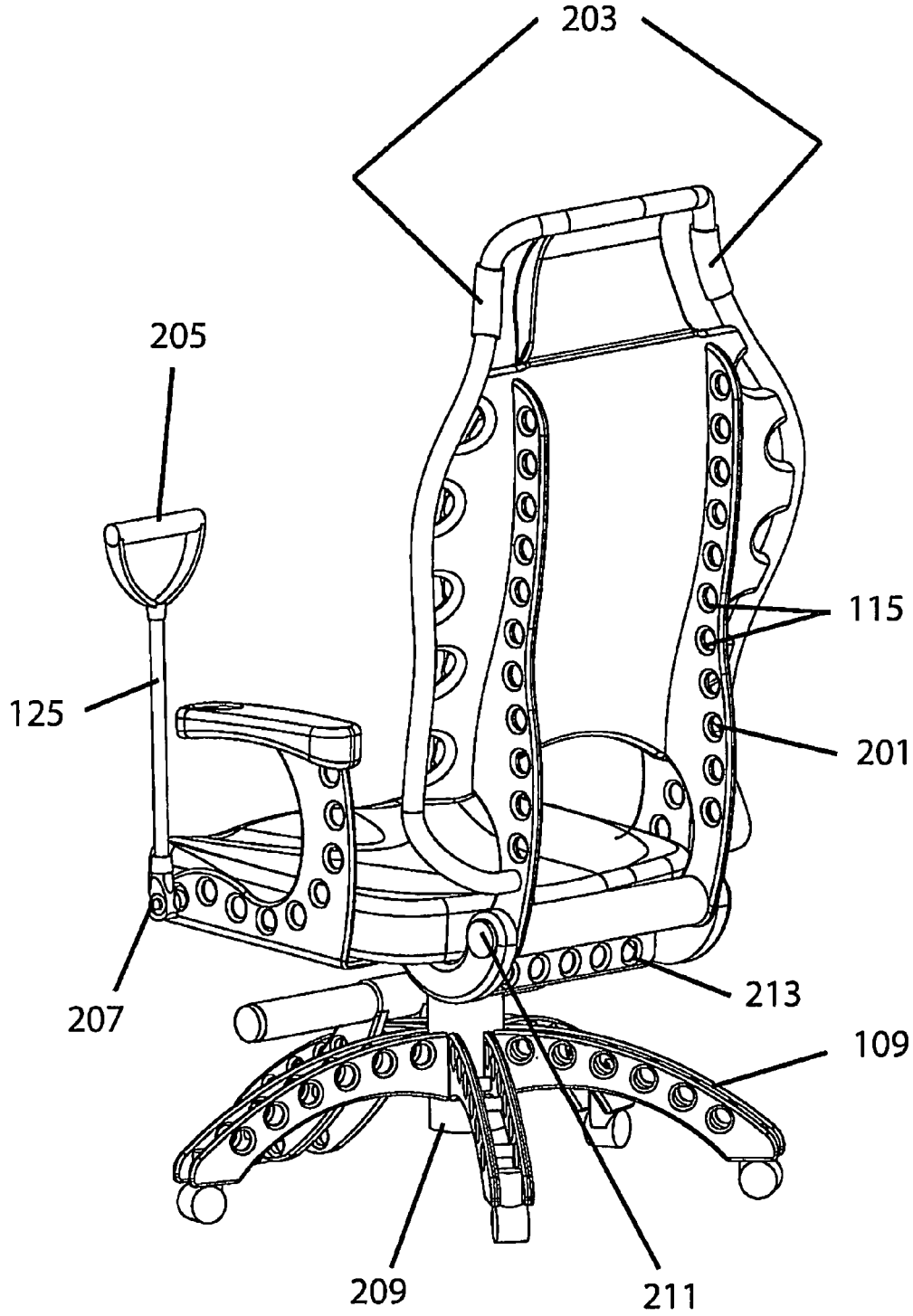
FIG. 2 is an exemplary rear perspective view of an exercise chair system according to an aspect of the present invention.
Figure 3:
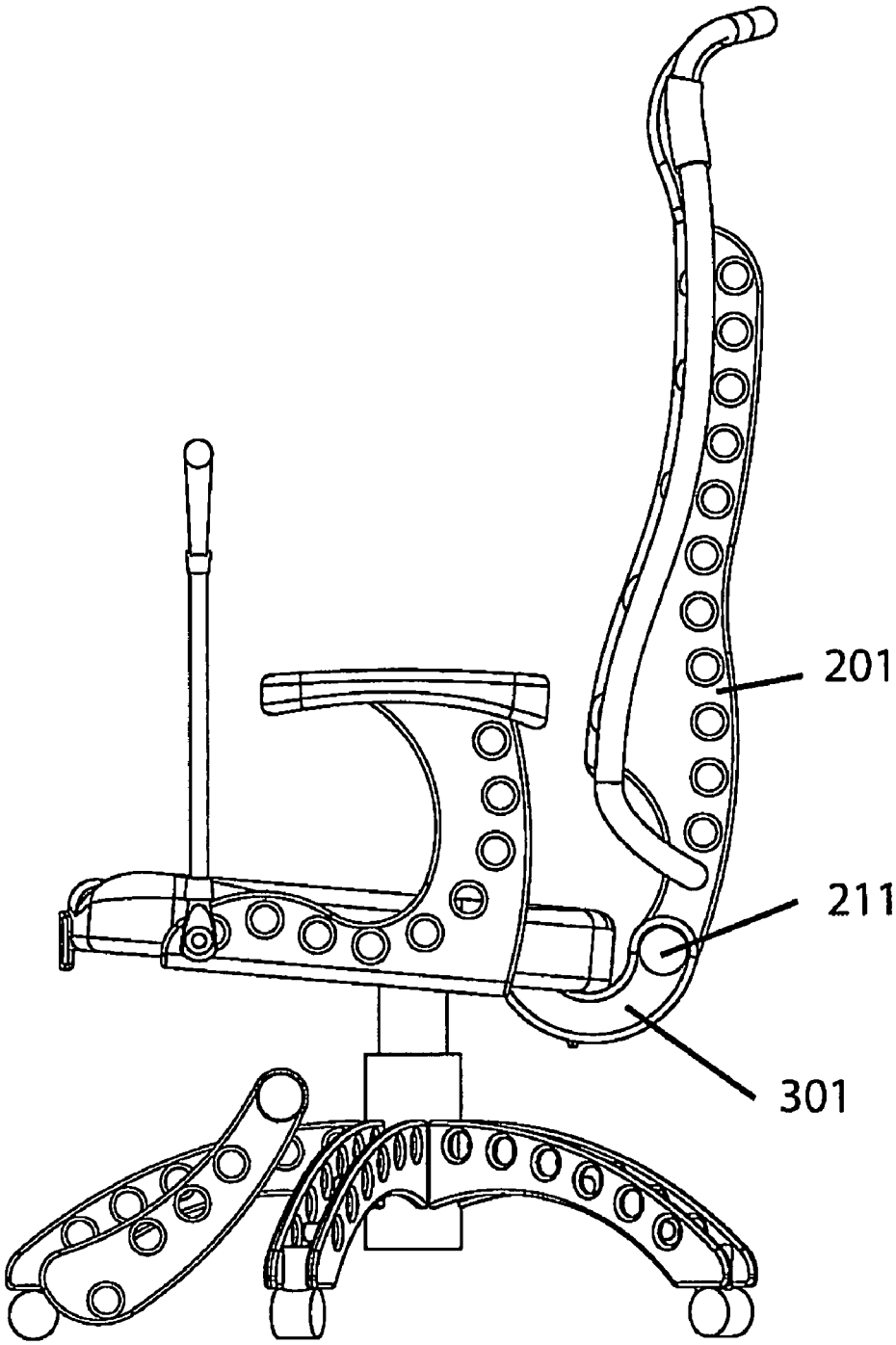
FIG. 3 is an exemplary side view of an exercise chair system according to an aspect of the present invention.
Figure 4:
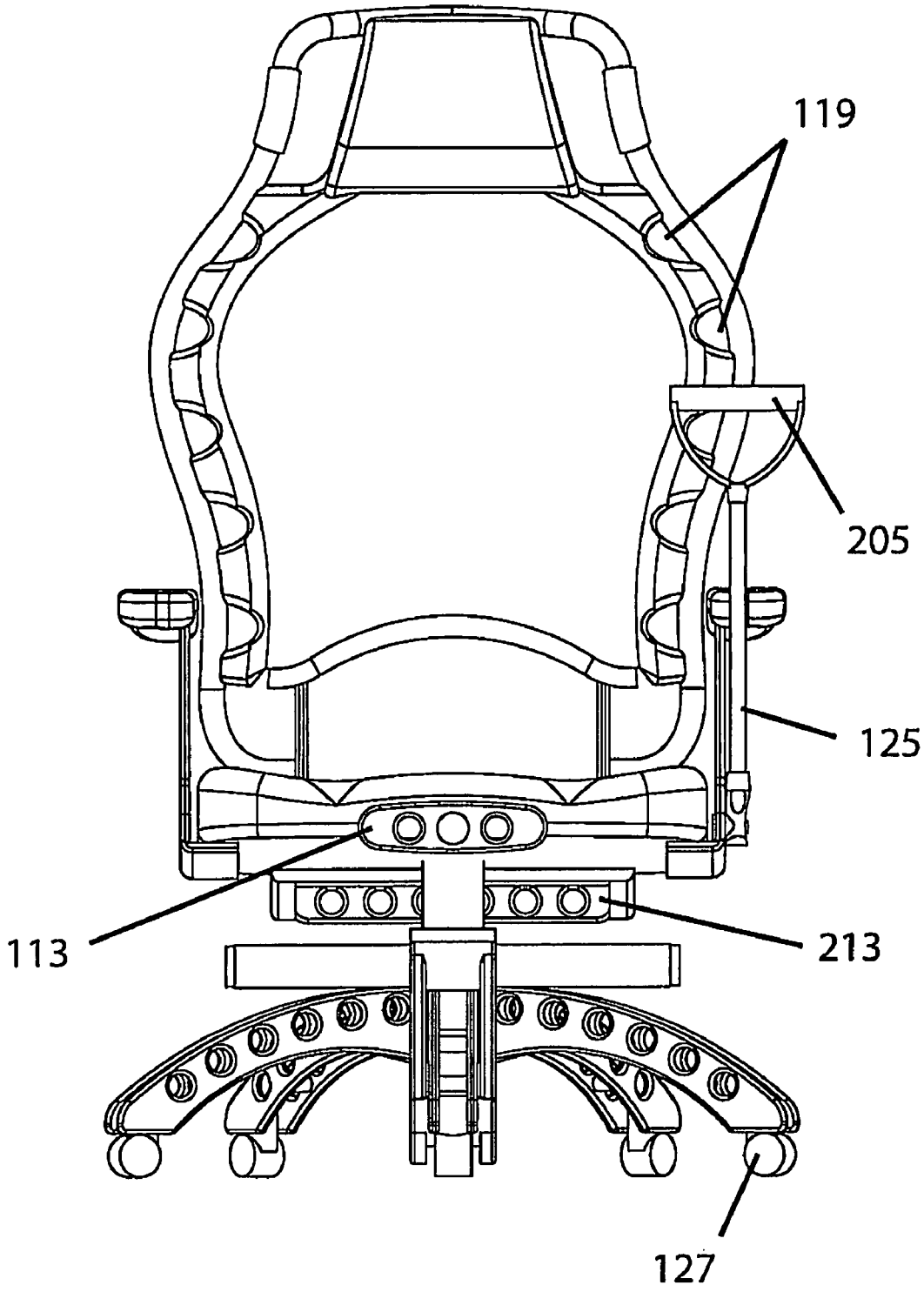
FIG. 4 is an exemplary front view of an exercise chair system according to an aspect of the present invention.
Figure 5:
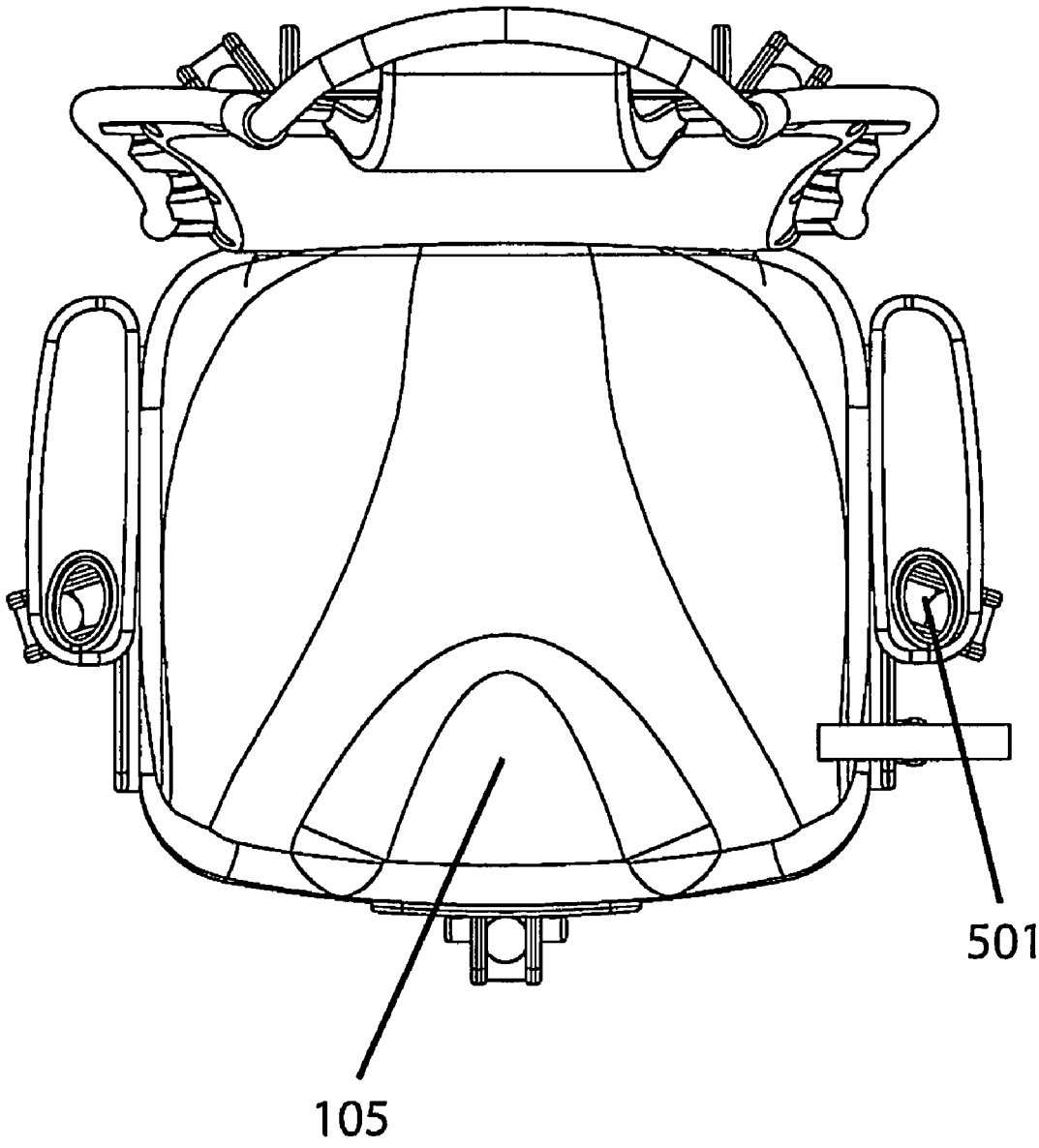
FIG. 5 is an exemplary top view of an exercise chair system according to an aspect of the present invention.

It should be understood that the drawings are for purposes of illustrating the concepts of the invention and are not necessarily the only possible configurations for illustrating the invention.

DETAILED DESCRIPTION OF PREFERRED EMBODIMENTS

Referring now to the Figures, FIGS. 1-6 are exemplary views of an exercise chair system 100 according to an aspect of the present invention. Chair 100 is comprised of a frame member 101 configured to support (e.g., preferably shaped to a perimeter of) a backrest 103, which may include an integrated head rest or cervical support 121. Back rest 103 may be ergonomically formed and/or contoured to include lumbar support, etc. The neck support 121 may comprise a cushioned material or pad (e.g., comprised of rubber, foam, plastic, etc.) that may be affixed to or be integrally formed with the back rest 103. The neck support 121 is preferably designed to provide contact with and ergonomic support for the user's head and neck.

Frame member 101 may include hand grips 203 positioned on either side of head rest 121. Hand grips 201 may be comprised, e.g., of foam or any other soft, deformable cushioning material and/or may be integral with the frame member 101 and/or ergonomically formed. The cushioning material may comprise, e.g., rubber, foam, plastic, etc. or any other material which may improve comfort and/or frictional grip. Alternatively, the hand grips 201 may be integrally formed with the frame 101 and e.g., comprise a shape contoured for maximum comfort and security during gripping.

Back rest 103 may include at least one rear attachment member 201 affixed on a rear surface of the back rest 103. Rear attachment members 201 may comprise e.g., at least a pair of elongate rails preferably affixed to the rear surface of the back rest and positioned so as to run substantially lengthwise along the back rest 103.

Figure 6:
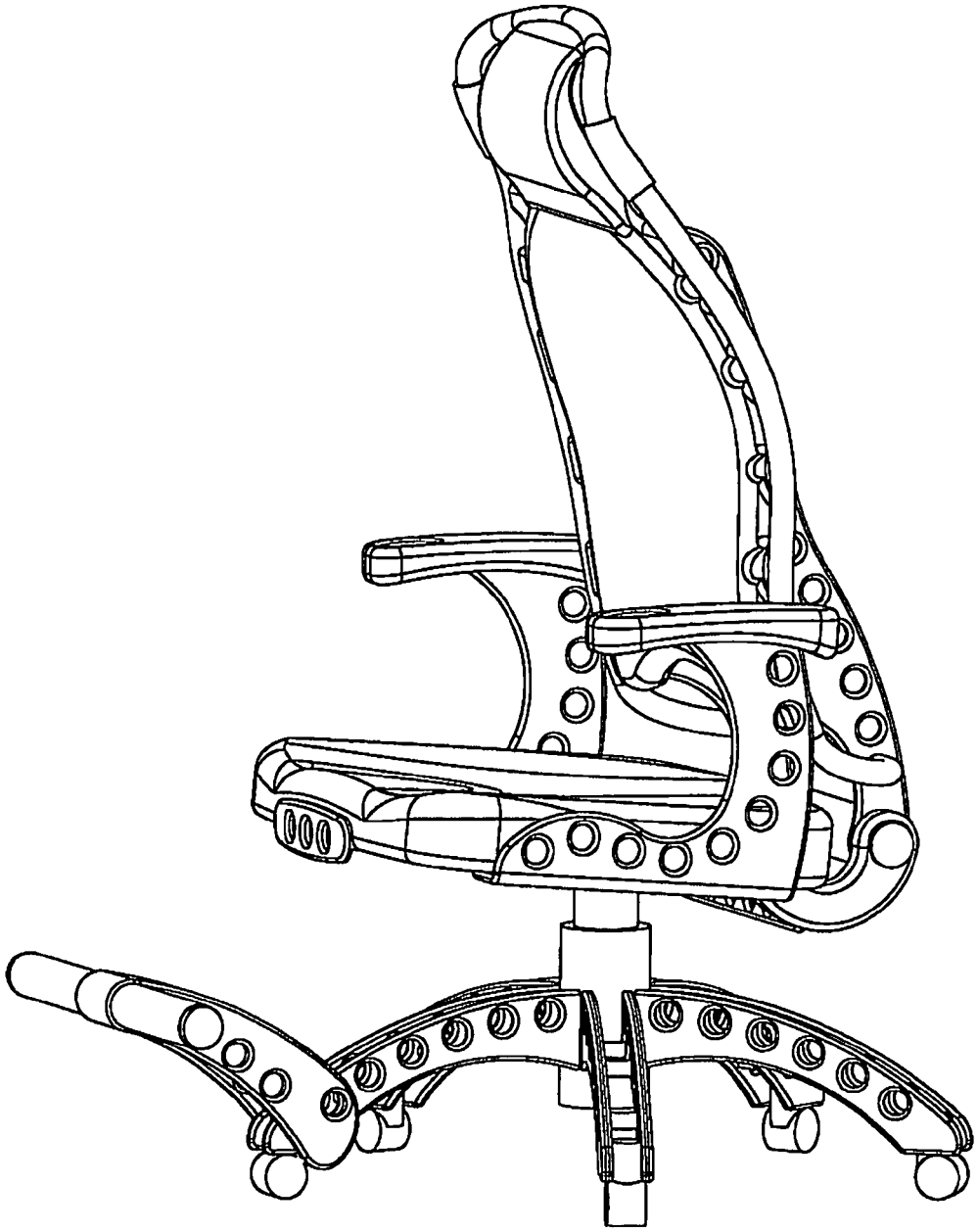
FIG. 6 is an exemplary front perspective view of an exercise chair with an extended leg rest and tilted back rest according to an aspect of the present invention.

The back rest 103 is preferably pivotally mounted to a seat 105, e.g., via rear attachment members 201. For example, a pivot joint 211 may be provided to pivotally affix each rear attachment member 201 to a corresponding seat arm 301, which is mounted onto the seat 105. Accordingly, the back rest 103 may be positioned and moved at various angles relative to the seat 105; for example, in a substantially upright position as shown in FIGS. 1-5 or in a slightly forward position as shown in FIG. 6. Alternatively, the back rest 103 may be reclined rearwards. The back rest may be locked in place via a locking mechanism (e.g., detents, grooves, locking pins, etc.) once a desired position is reached and desired to be maintained.

Seat 105 may include a front seat attachment member 113, and a rear seat attachment member 213. A pair of arm attachment members 107, each having an arm rest 123 attached thereon, is preferably affixed to either side of the seat 105. Each arm attachment member 107 may be configured to be adjustable in height, position and orientation (e.g., forwards, backwards, flip-down, etc.) for adapting to user preferences.

A base or center post 209 is provided having a first end affixed to a bottom of the seat 105. A plurality of chair supports 109 is provided preferably extending radially from the center post 209 proximate to a second end for providing a stable base support for the chair 100. For example, at least about five supports 109 may be provided for optimal weight distribution, stability and balance. Each support 109 may have a swivel wheel or caster 127 attached thereon to impart mobility to the chair 100. Further, the seat 105 may be configured to be rotatable relative to the center post 209 and/or the supports 109 may be configured to be rotatable relative to the center post 209 so as to provide full 360 degree rotational capability to the chair 100. The seat 105 and/or supports 109 may be configured to be locked into a stationary configuration so as to prevent rotation of the seat 105 when so desired.

At least one support 109 may include a leg support member 111 having a first end pivotally attached to the support 109 and a second end having a footrest 117 attached thereon. The leg support 111 may be pivoted to a retracted position (e.g., as shown in FIGS. 1-4) when not in use and moved to various degrees of extended positions (e.g., as shown in FIG. 6) during use for providing foot support for the user. Once a desired position has been achieved, the leg support 111 may be locked into place to prevent movement.

In one embodiment, frame 101 may be intermittently integrated with backrest 103 so as to form a plurality of voids 119 along the lateral sides of the back rest 103. Further, each arm rest 123 may include at least one arm rest void 501. Voids 119 and 501 are preferably sized and shaped so as to allow pass-through of various desired exercise implements, described further below.

Rear attachment members 201, arm attachment members 107, front and rear seat attachment members 113, 213, chair supports 109 and leg support 111 may include a plurality of attachment points 115. Such attachment points 115 may comprise, e.g., a plurality of apertures preferably substantially uniform in shape and size and configured for removable attachment of various exercise implements thereon. Alternatively, the attachment points 115 may comprise any combination of apertures having various sizes/shapes, ring attachments, hooks, etc., for enabling secure removable attachment of exercise implements designed for use therewith, as described herein. E.g., it is to be noted that attachment points 115 may comprise any releasable attachment means or combination thereof, e.g., ring and dee closures, clasps, wings and clamps, screws, male/female connection elements, spring-loaded couplers, etc.

In yet another embodiment, e.g., as described below with respect to FIGS. 22-34, attachment points 115 may comprise one or more track members distributed throughout the chair and configured to permit slidable adjustment and attachment of various exercise implements thereon.

The attachment points 115 may be provided in any number, pattern, and distribution configuration throughout the chair 100. In an embodiment wherein the attachment points 115 comprise apertures, while apertures having similar dimensions/sizes throughout are preferred, apertures having varying sizes, shapes, etc. may be contemplated.

An exemplary exercise implement for use with chair 100 may comprise, e.g., a resistance band 125 having a handle 205 at a first end and an attachment coupling 207 at a second end configured for removable attachment onto at least one of the attachment points 115 on chair 100. The resistance band 125 may be comprised of any elastic, resilient material (e.g., 'bungee' cord material) with various levels of resistance (tension) being facilitated via provision of bands 125 of varying diameters, materials, densities, etc.

Any number of a variety of resistance bands may be provided of varying thicknesses and/or lengths to vary the level of resistance for the user. Such a variety of resistance bands may be enclosed in the kit form of the present invention. The resistance bands may be, e.g., color and/or number coded according to their various levels of resistance and may comprise any flexible, elastic and resilient material, for example, rubber, rubber composites, rubberized elastic, latex, or any other synthetic or natural elastic materials. During use of the exercise implement, the resistance band 125 may be extended/elongated under tension and contracted to its original state in a repetitive fashion.

Figure 7:
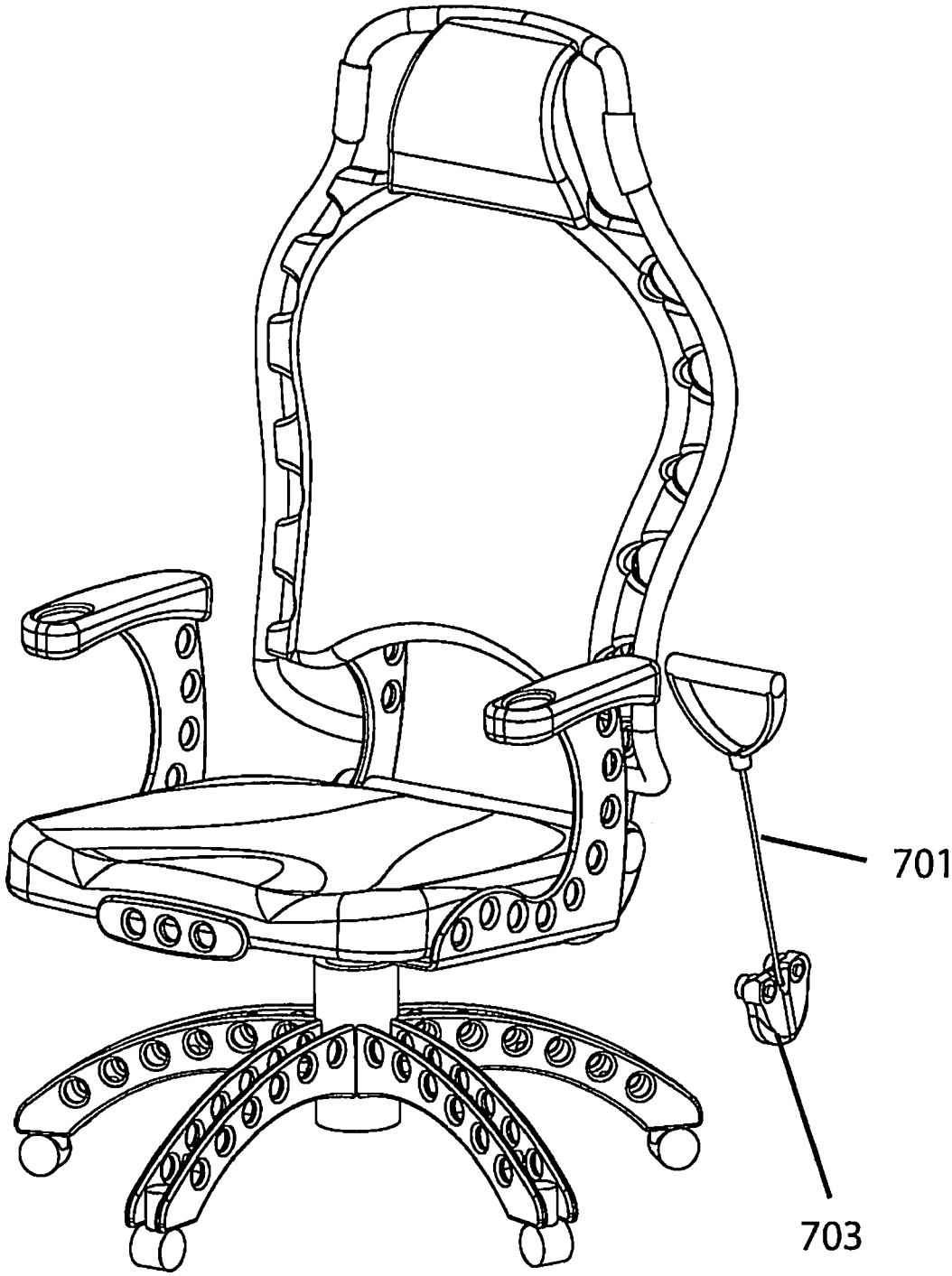
FIG. 7 is an exemplary front perspective view of an exercise chair and a resistance device according to an aspect of the present invention.
Figure 8:
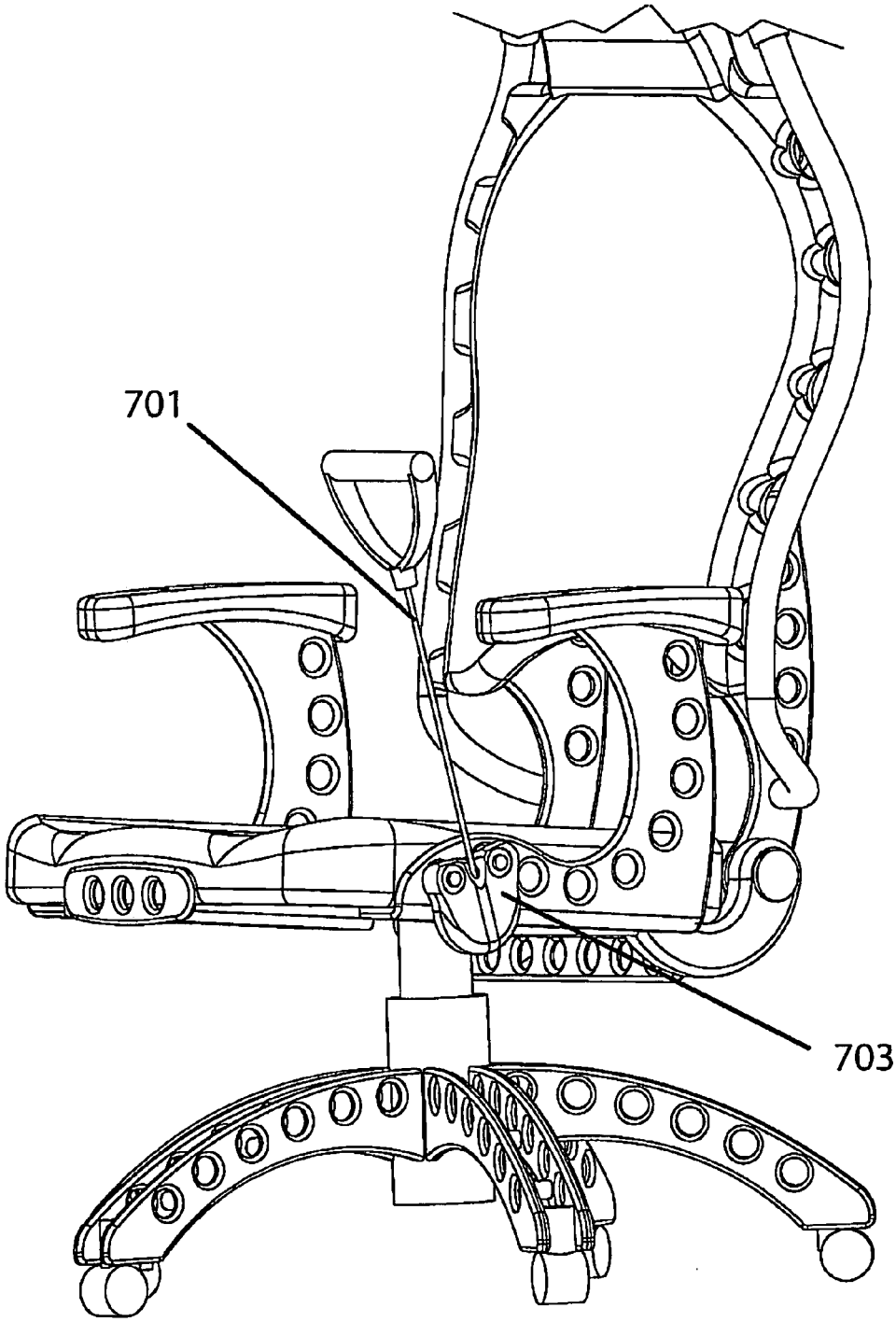
FIG. 8 is an exemplary front perspective view of an exercise chair having the resistance device shown in FIG. 7 attached thereon according to an aspect of the present invention.

According to one exemplary mode of attachment of an exercise implement 125, a coupling 207 may be configured to be removably attachable to a single attachment point 115 (e.g., as shown in FIGS. 1-5). According to another embodiment, an exercise implement 701 may be provided having a multi-point coupling 703 configured to be simultaneously removably attachable to a plurality of attachment points (e.g., to two attachment points 115, as shown in FIGS. 7-8).

Figure 9:
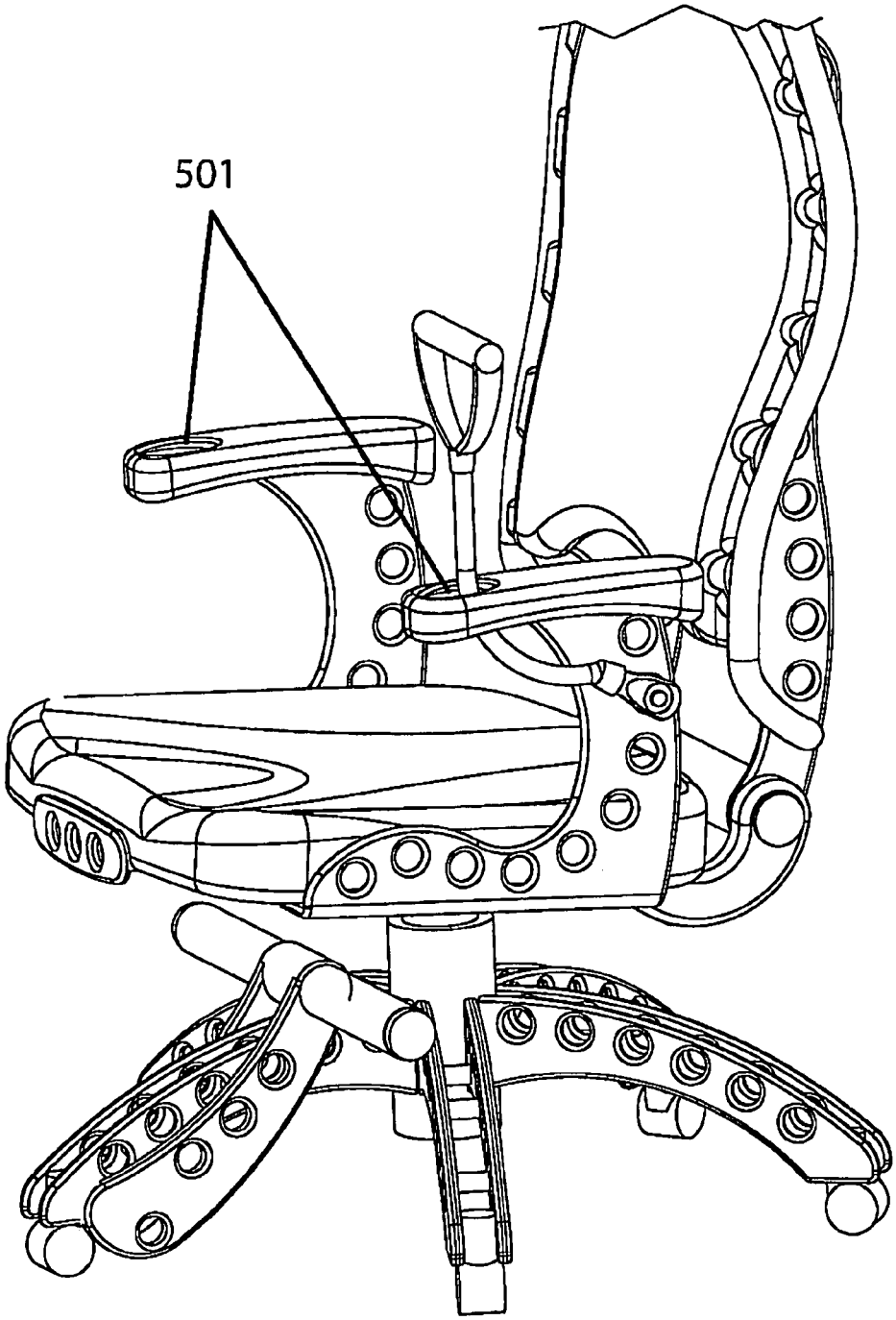
FIGS. 9-15 depict exemplary methods for attachment of resistance devices onto an exercise chair according to various aspects of the present invention.
Figure 10:
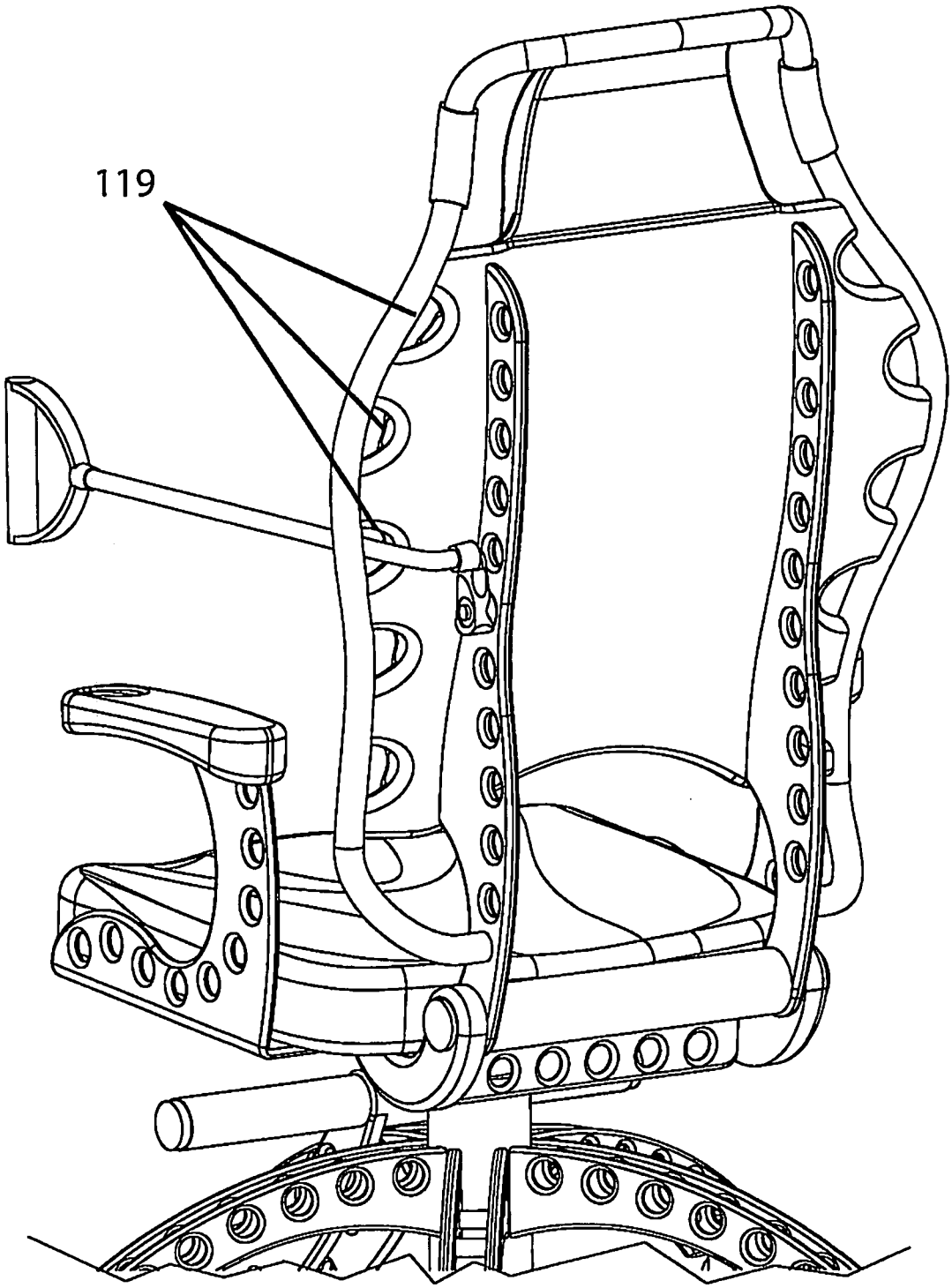
Figure 11:
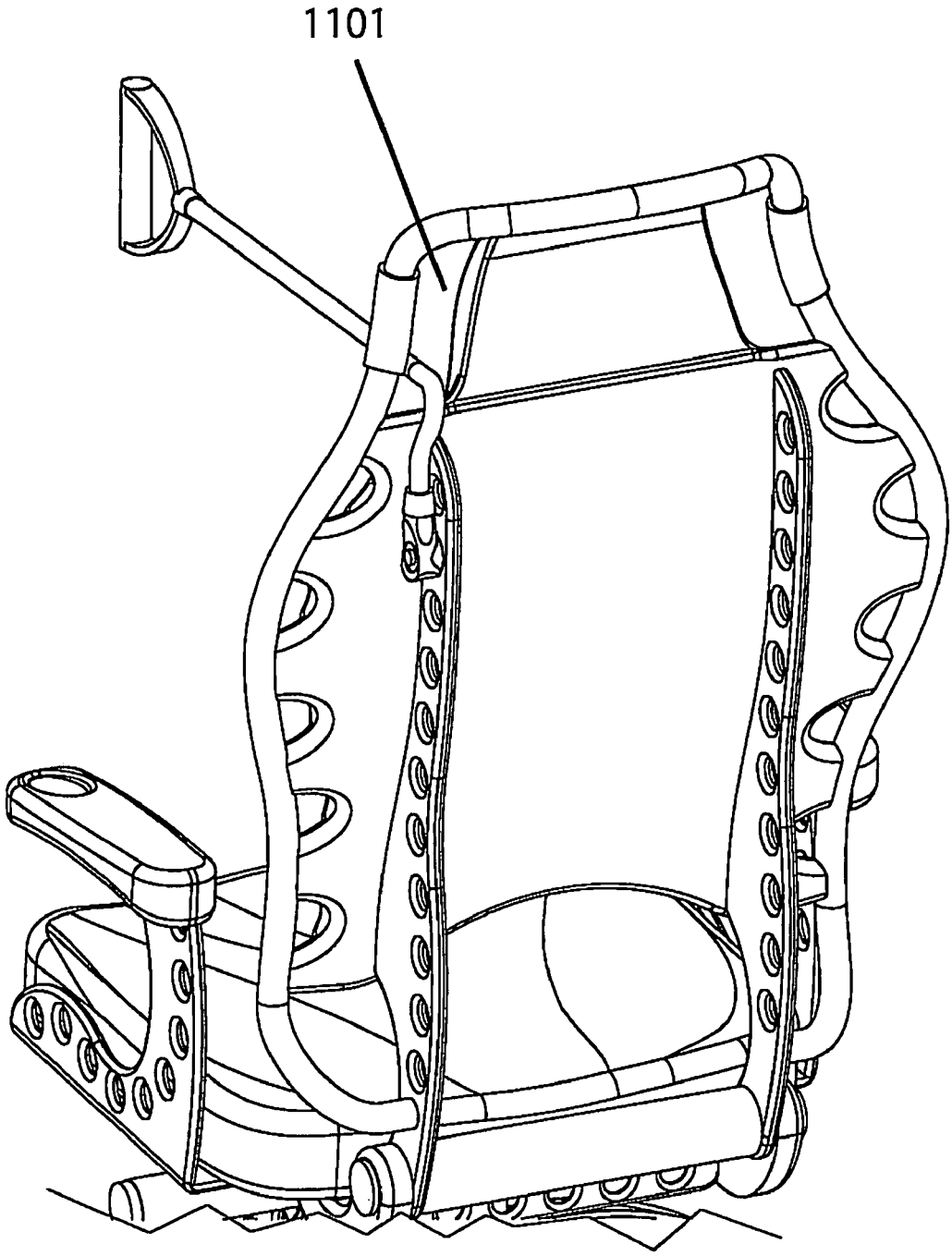

Each coupling 207 or multiple point coupling 703 may be configured to be rotatable upon attachment to an attachment point 115. The implement 125 may be passed through any of the voids 119, 501, 1101 so as to vary leverage and range of motion during exercise. For example, as shown in FIGS. 9-11, exercise implement 125 may have a first end coupled to any one of the rear attachment members 201 or arm attachment members 107, and second end passed through any of voids 119 or 501, with handle 205 in position for grasping by a user seated in the chair 100. Upon grasping of the handle of implement 125, the user may proceed with various movements to exercise/stretch various muscle groups.

In another embodiment, e.g., as shown in FIGS. 12-15, an exercise implement 1301 comprised of a resistance band having a coupling point 1303 at each end may be provided. Each coupling point 1303 may be attached to any feasible combination of separate attachment points 115 for facilitating a variety of different exercises. E.g., each coupling point 1303 may be affixed to an attachment point on any of rear attachment members 201, arm attachment members 107, front and rear seat attachment members 113, 213, chair supports 109 and leg support 111, in any combination so as to provide various configurations to exercise different muscle groups.

Advantageously, since placement and orientation of the exercise implement is adjustable to various positions throughout the chair 100 via the plurality of attachment points 115, multiple configurations may accordingly be created and working of various muscle groups may be facilitated. One or more exercise implements 125 and/or 1301 may be used and attached simultaneously for controlling resistance levels, exercise movements, etc.

Figure 12:
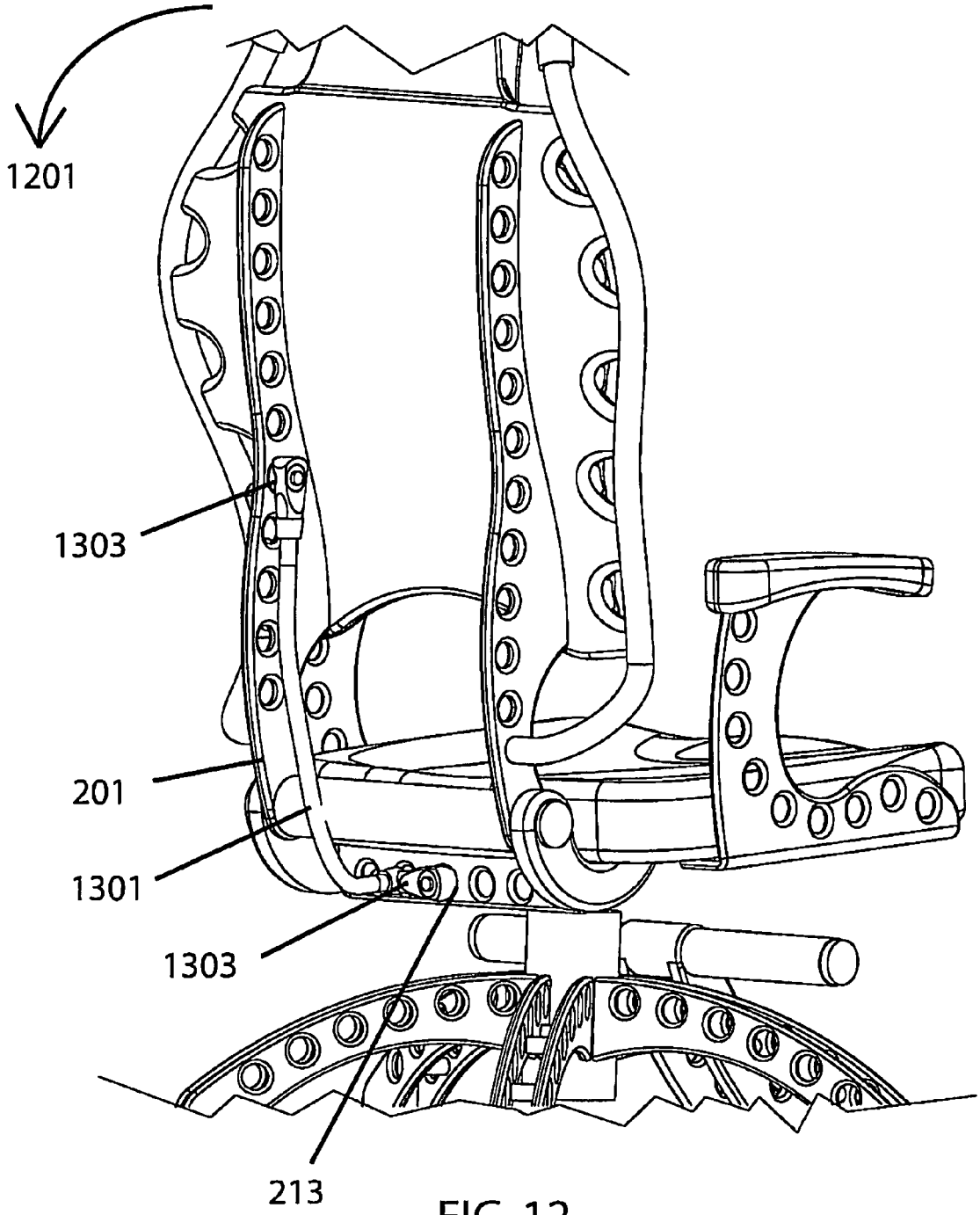
Figure 13:
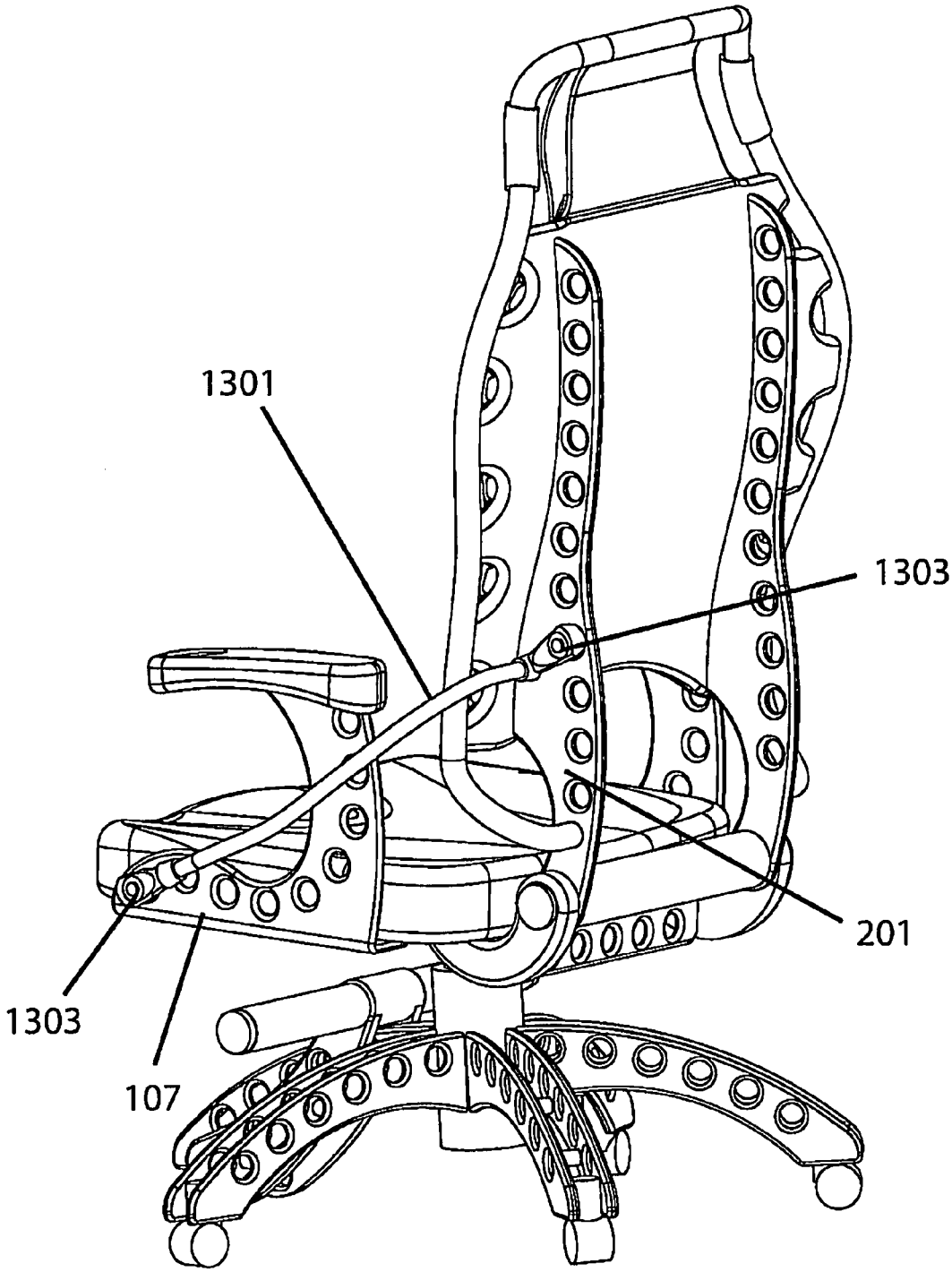

For example, the configurations shown in FIG. 12 (in which one coupling point 1303 is connected to a rear attachment member 201 and a second coupler 1303 is affixed to a rear seat attachment member 213) and FIG. 13 (in which one coupling point 1303 is connected to a rear attachment member 201 and a second coupler 1303 is affixed to an arm attachment member 107) may be used for providing resistance when the back rest 103 is pressed, e.g., in a backwards direction 1201. Such configurations may be employed, e.g., for exercising the back muscles of a seated user.

Figure 14:
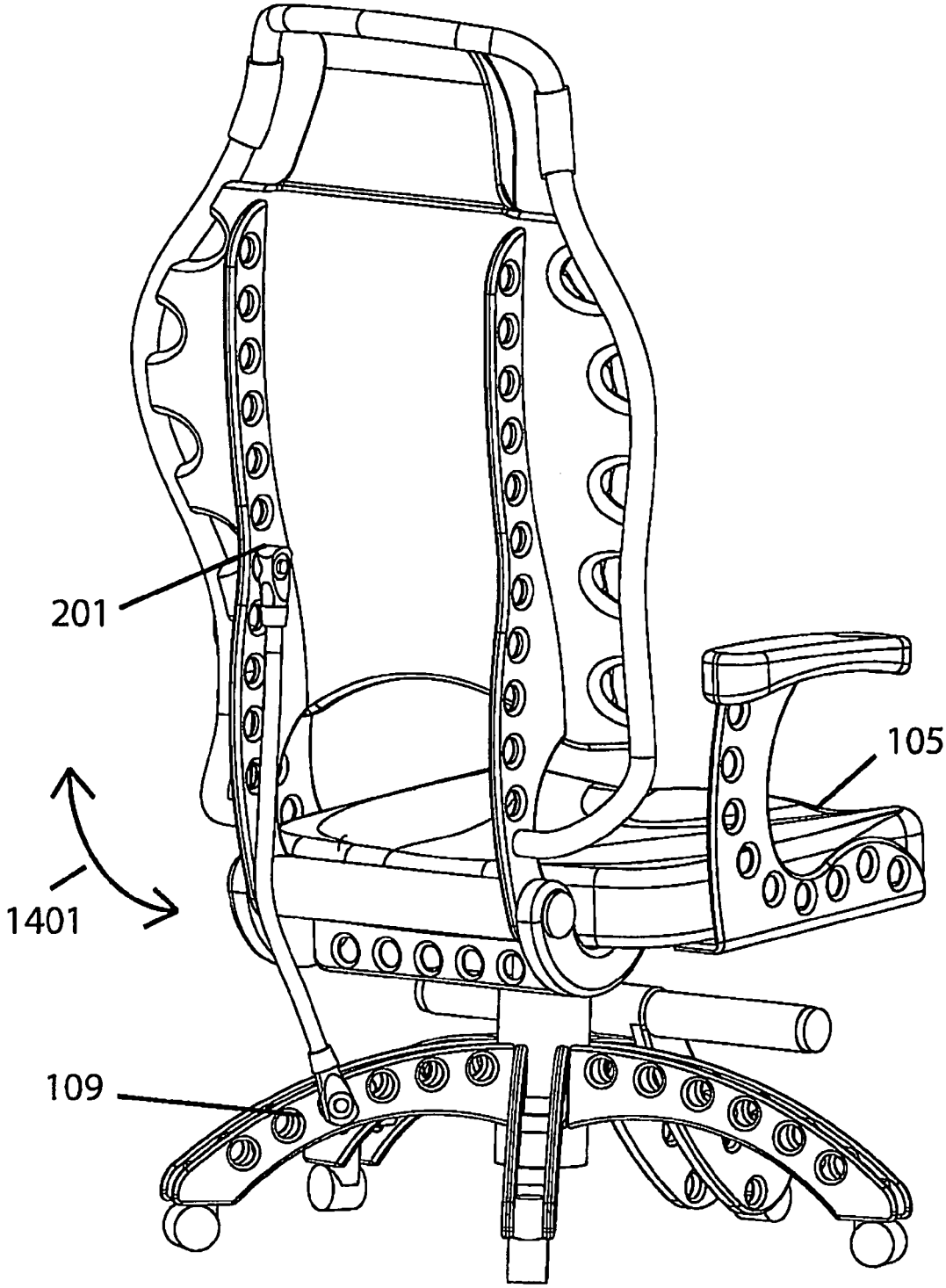
Figure 15:
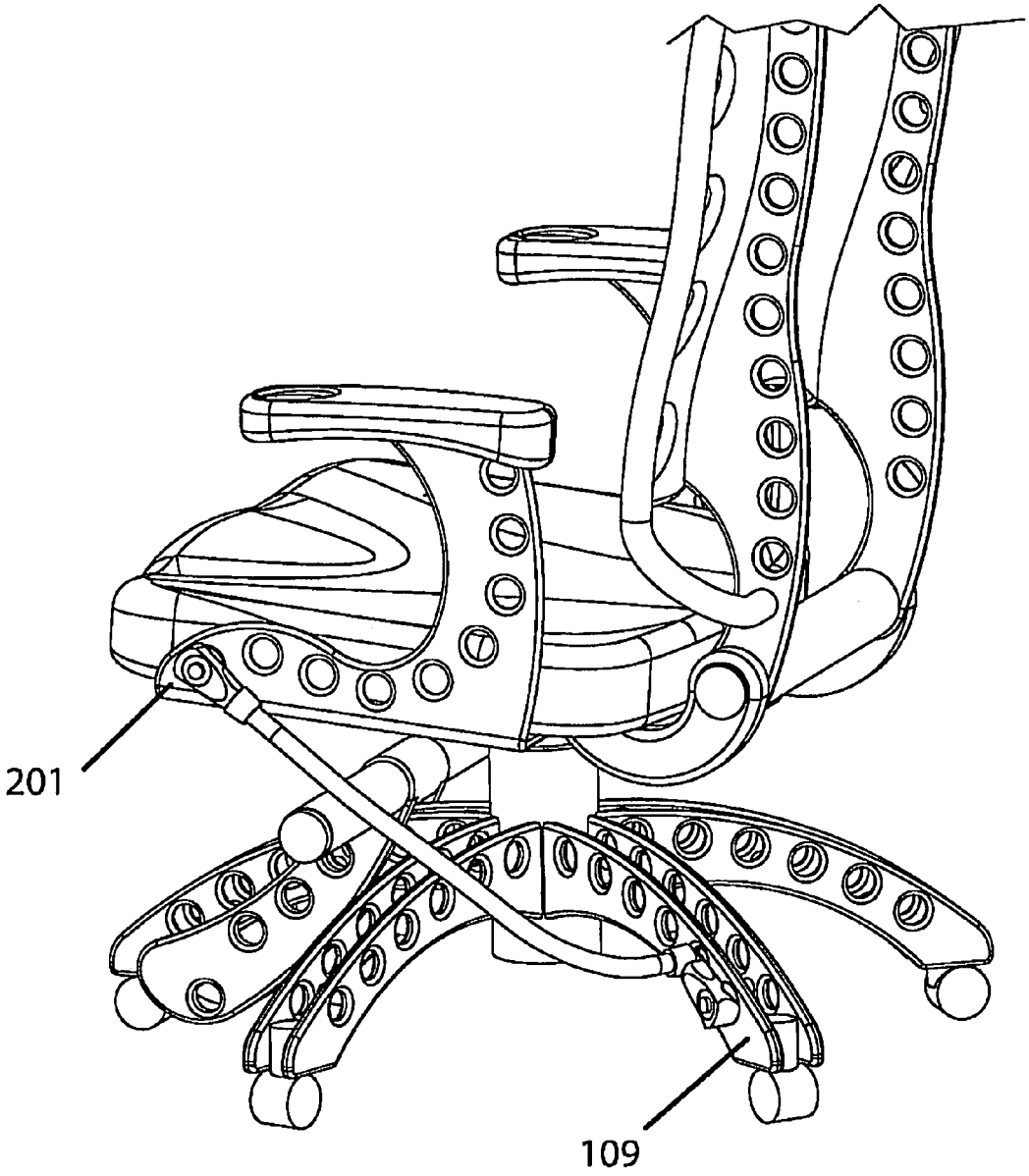
Figure 16:
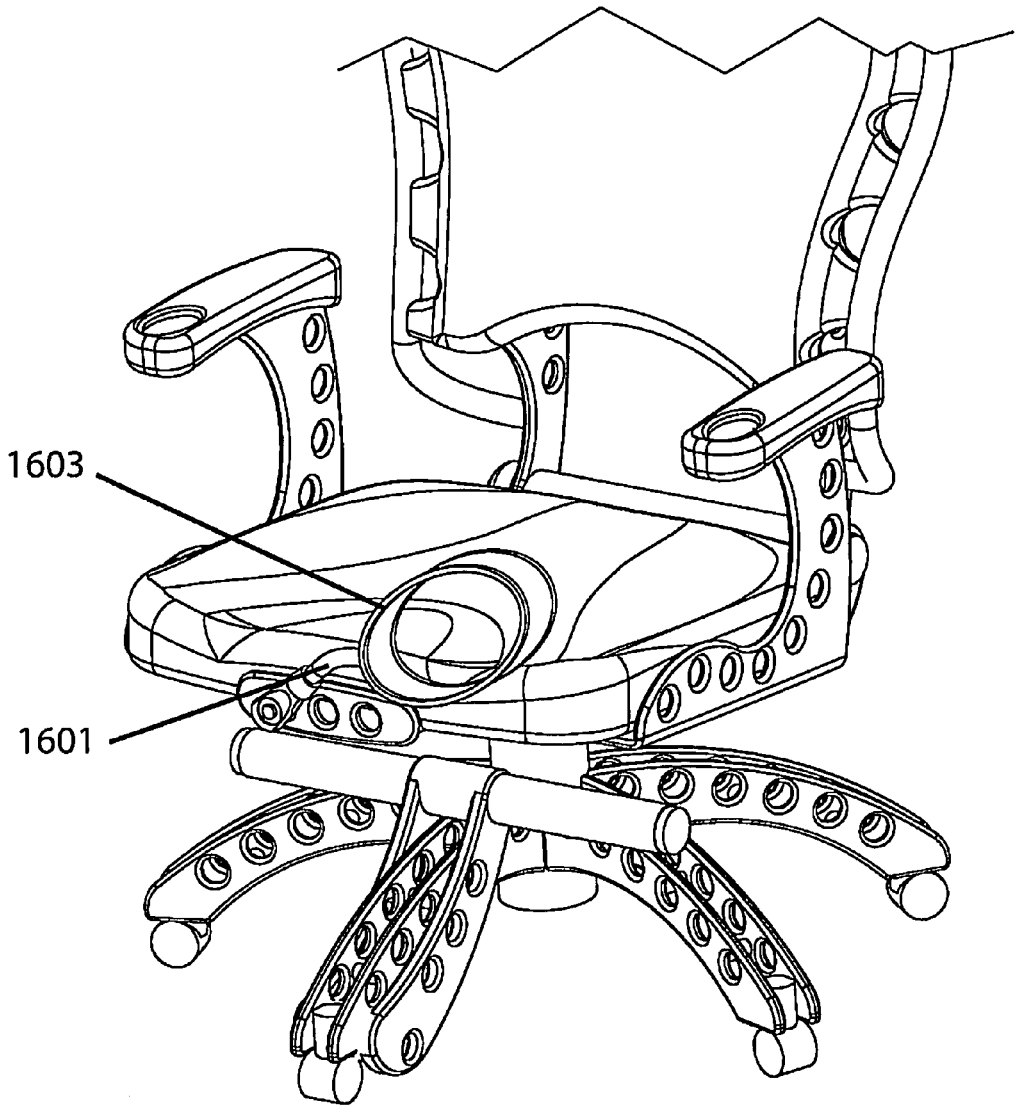
FIGS. 16-18 depict exemplary methods for attachment of an alternate resistance device onto an exercise chair according to various aspects of the present invention.
Figure 17:
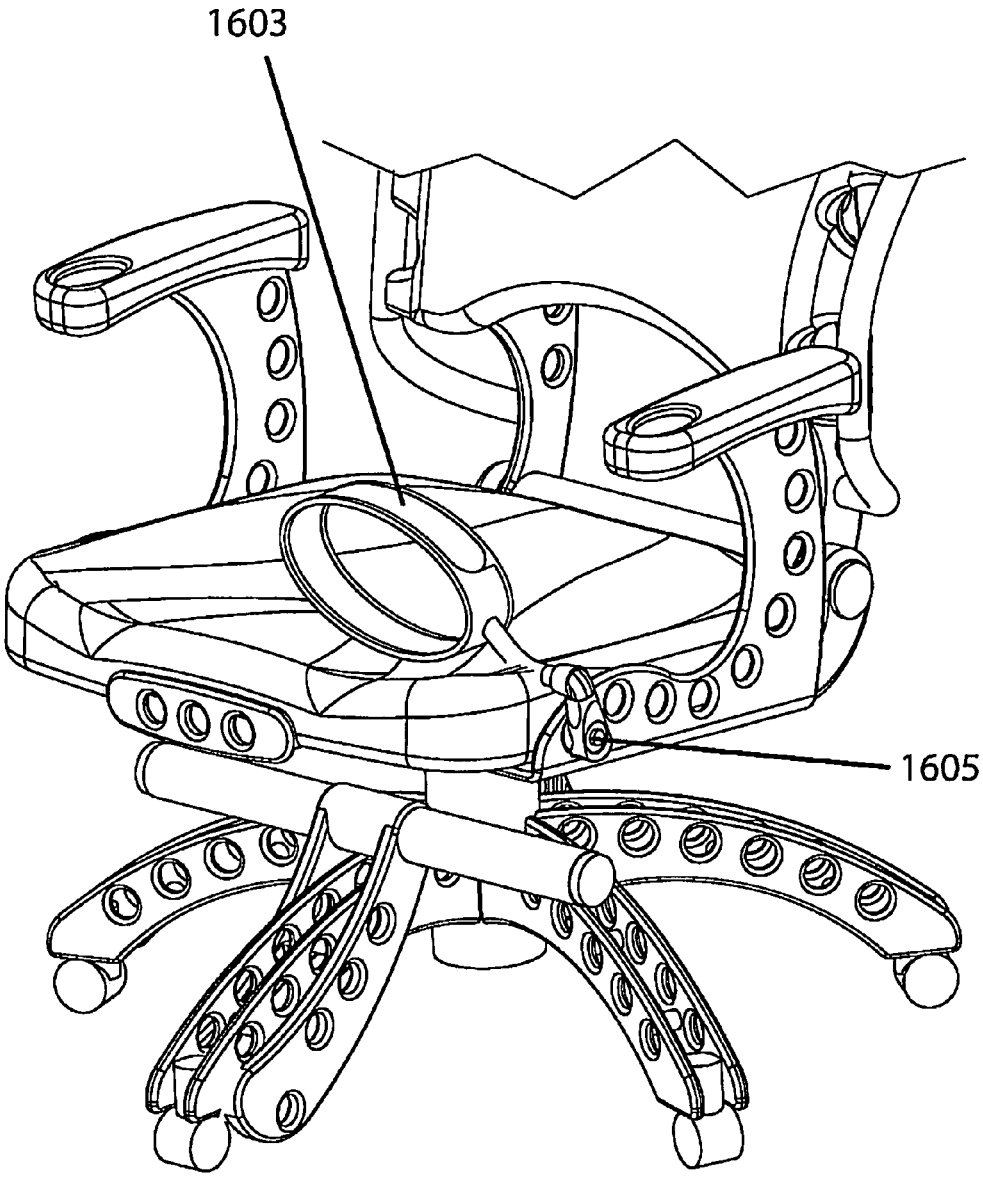
Figure 18:
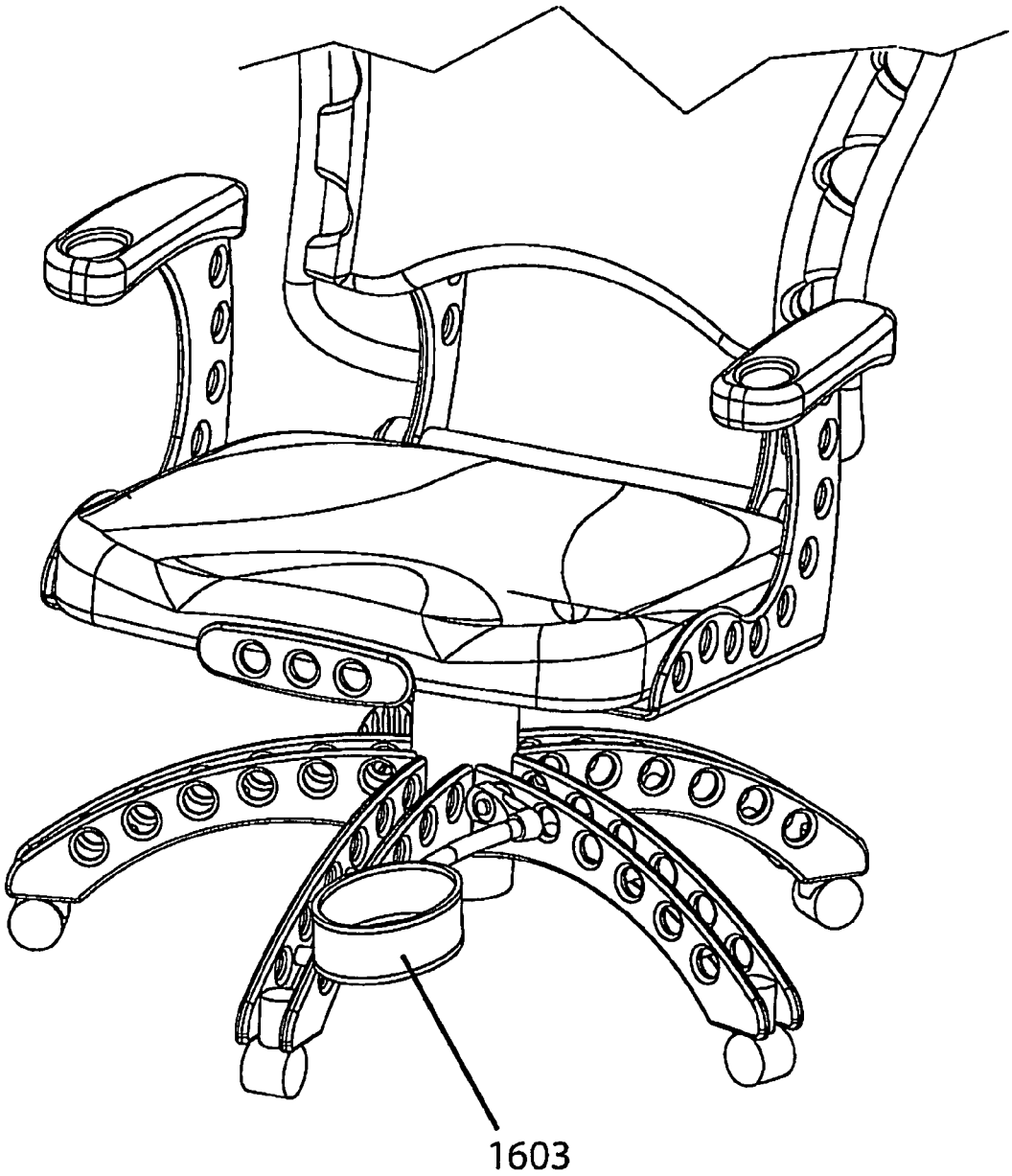

The exemplary configurations shown in FIG. 14 (in which one coupling point 1303 is connected to a rear attachment member 201 and a second coupler 1303 is affixed to a chair support 109) and FIG. 15 (in which one coupling point 1303 is connected to an arm attachment member 201 and a second coupler 1303 is affixed to a chair support 109) may be used for providing resistance to the chair seat 105 in a rotational direction 1401. These configurations may be used for exercising the torso of a seated user by providing tension during swivel and twisting movements.

FIGS. 16-19 depict exemplary alternate embodiments of exercise implements 1601, 1901 according to aspects of the present invention and various attachment configurations of same. For example, the exercise implement 1601 may include a circular wrap 1603 at one end and a coupling element 1605 at a second end. The wrap 1603 may be comprised of elastic and/or adjustable material and configured to allow a user to insert a limb there through, thus securing, e.g., a user's ankle, thigh, wrist, etc. during exercise with the exercise implement 1601. The wrap 1603 imparts resistive force on the user's limbs when the user moves from a neutral position during exercise movements.

Figure 19:
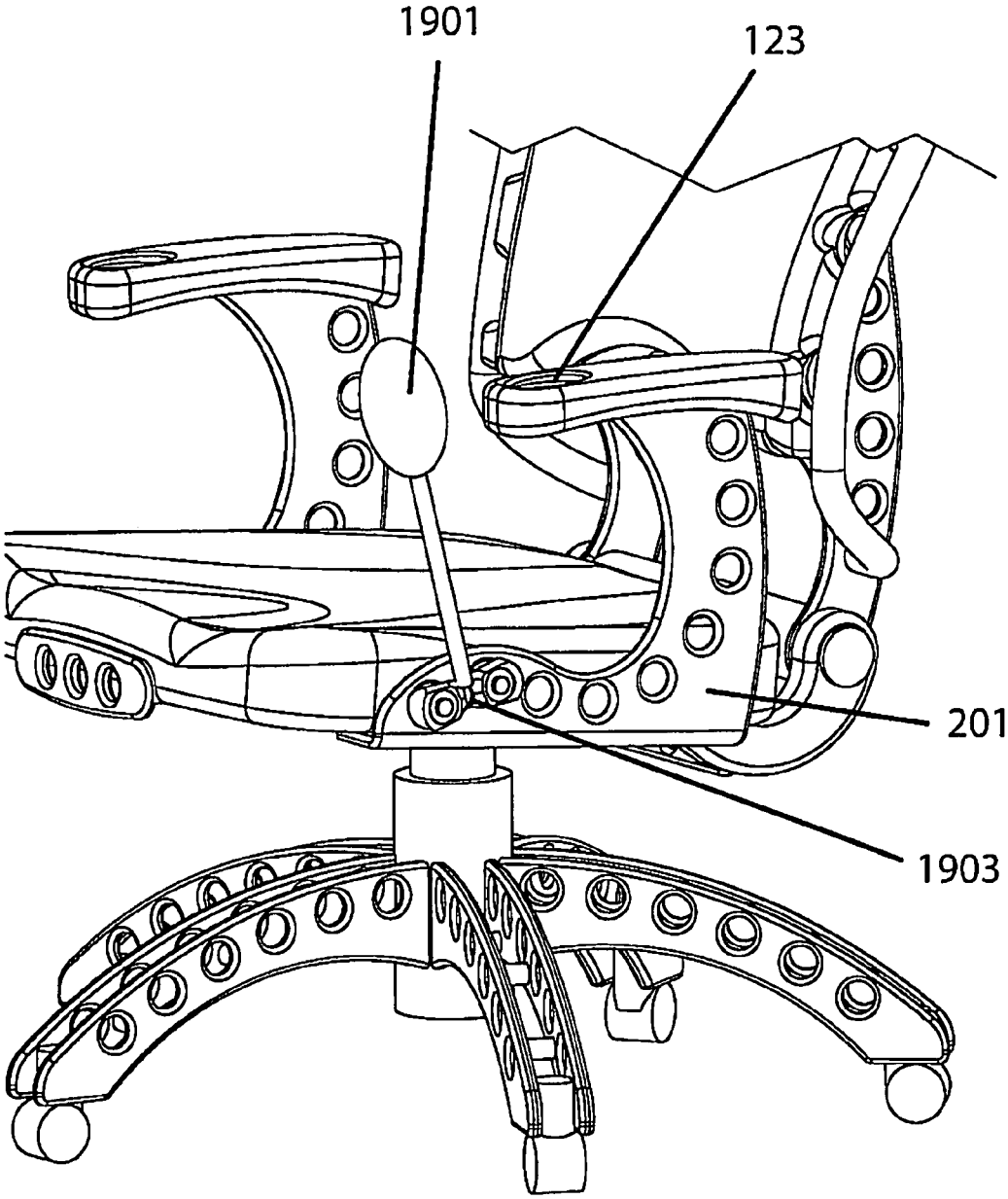
FIG. 19 is an exemplary front perspective view of a leg piece in a locked position according to an aspect of the present invention.

FIG. 19 depicts an exemplary exercise implement comprising a stress relief device having a compressible head 1901 and dual coupling point 1903. Head 1901 may be comprised of a deformable, resilient material (e.g., foam, rubber, plastic) and/or may include a hollow air-filled chamber with a vent for permitting expulsion of air when head 1901 is compressed. When attached, e.g., to an arm attachment member 201, the head 1901 is positioned proximate to an arm rest 123. During use, head 1901 may be squeezed by the user as desired for tension relief and to exercise the wrist and forearm muscles.

Figure 20:
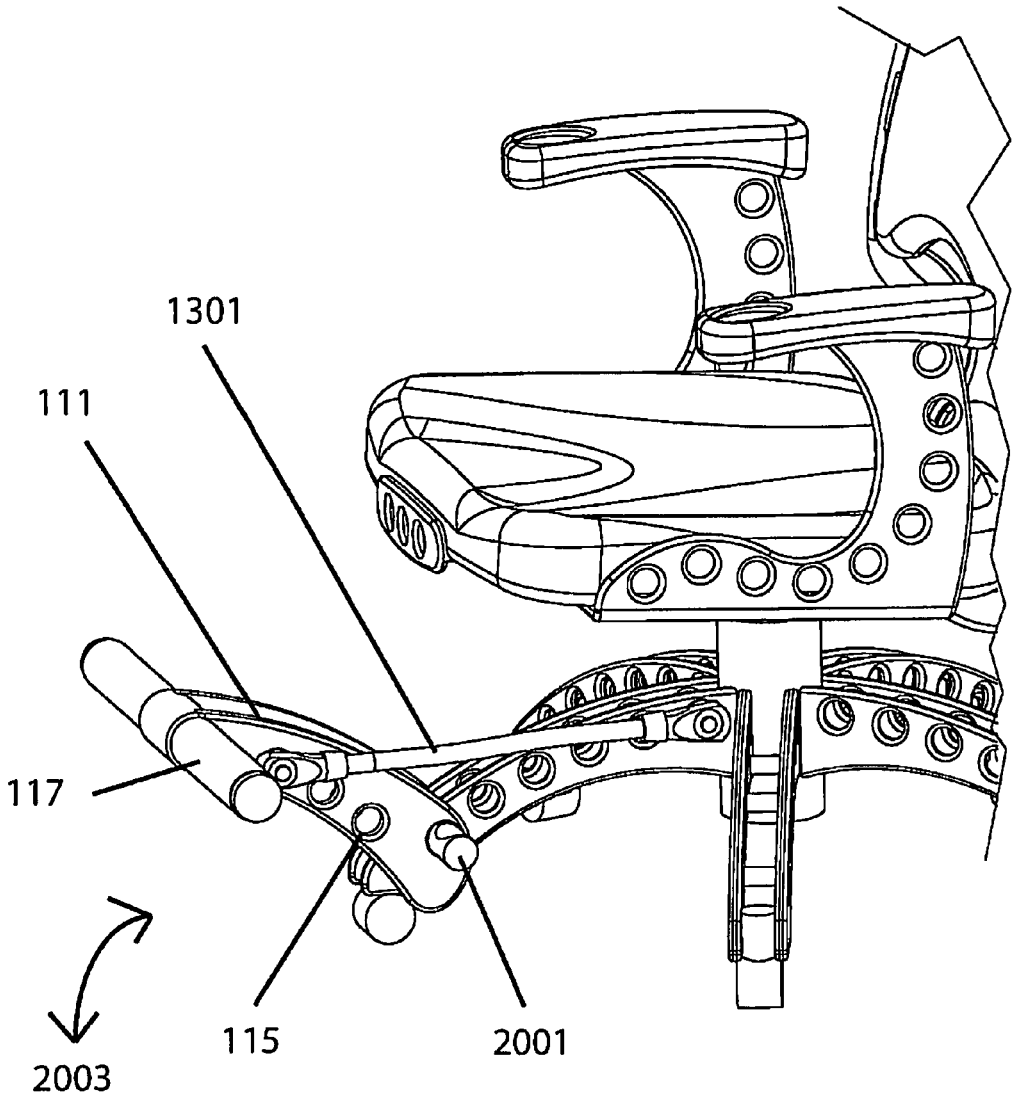
FIG. 20 is an exemplary front perspective view of an exercise chair having a resistance device attached to the leg piece according to an aspect of the present invention.

FIG. 20 depicts the leg support 111 secured in an extended position via insertion of a locking pin 2001 through a plurality of apertures coaxially aligned. The leg support 111 may be extended and retracted to various angles as desired by the user. Once a desired position is achieved, the locking pin 2001 may be inserted into respective aligned apertures 115, and the pin 2001 secured as such serves as a pivot point around which the leg support 111 may rotate. Once a desired angle is rotatably secured, an exercise implement 1301 may be attached for providing resistance training for a user's legs. For example, a first end of an exercise implement 1301 may be attached to a chair support 109 and a second end may be attached to the leg support 111 as shown in FIG. 20. To perform leg exercises, a user may place their feet on the footrest 117 and push upwards or downwards in direction 2003. The resilient tension provided by implement 1301 accordingly exercises the anterior, posterior and/or lateral muscles of the upper and lower legs and buttocks, for example, the sartorius muscle, gluteus maximus, rectus femoris muscle, long head of biceps femoris muscle, semitendinous muscles, gastrocnemius muscles, etc.

Figure 21:
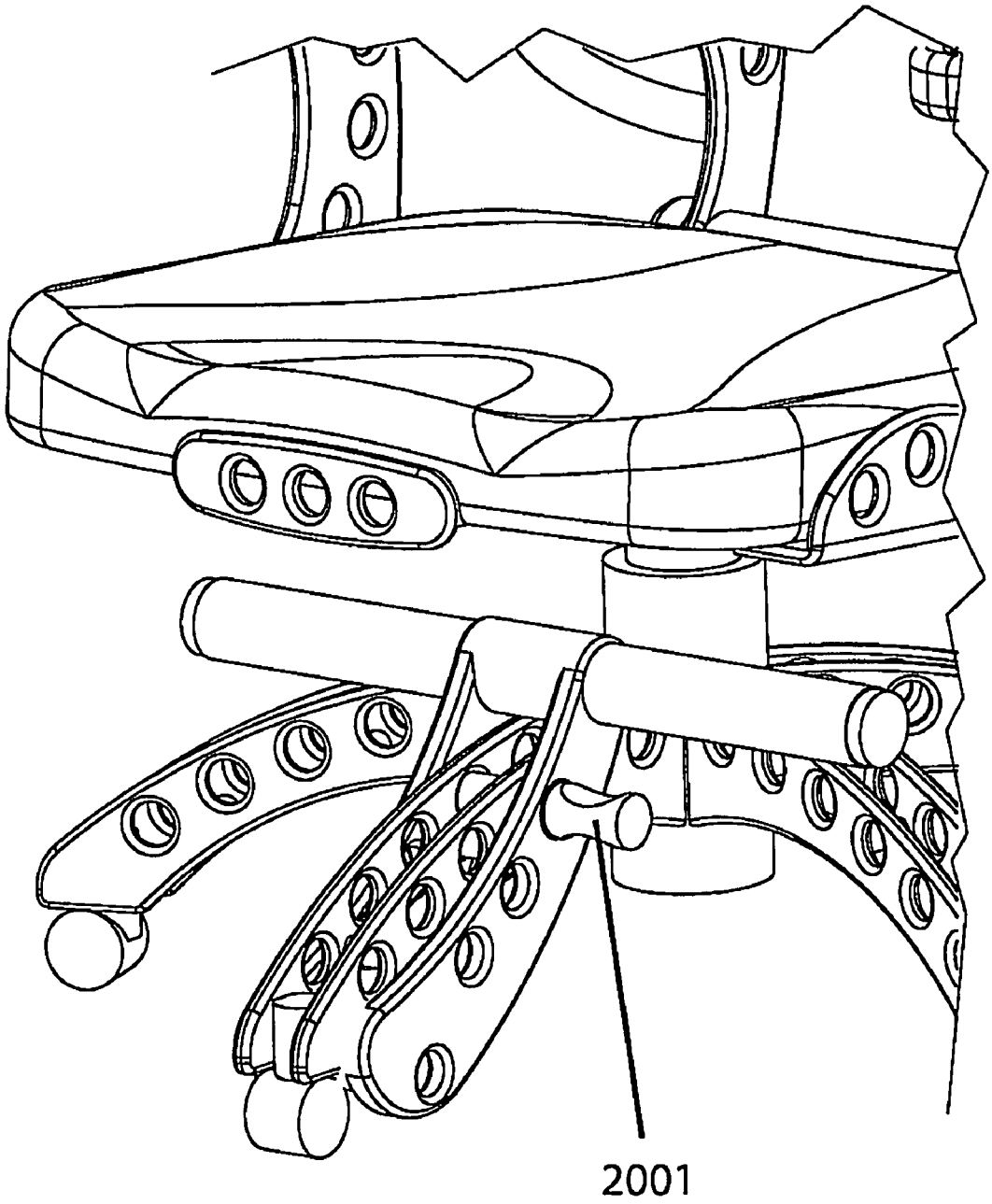
FIG. 21 is an exemplary front perspective view of an alternate resistance device attached onto an exercise chair according to another aspect of the present invention.

When leg exercises are not desired to be performed, the leg support 111 may be fully retracted so as to not interfere with the operation of chair 100 as a desk chair. FIG. 21 is an exemplary depiction of the leg support 111 in a fully retracted position and secured with locking device 2001.

A plurality of exercise devices (e.g., 125, 1301, 1601) may be simultaneously attached at various attachment points 115 to provide varied configurations for working the upper body, the lower body, and "core" muscle groups (e.g., the internal and external obliques, rectus abdominus and lower portions of the latissimus dorsi muscles) of the user. Thus, a wide variety of muscles and/or specific muscle groups may be worked either individually or simultaneously.

For example, an arm exercise implement 125 may be attached to arm attachment member 107 to provide an upper body workout, while an exercise implement 1301 may be attached to the leg support 111 and chair support 109 to provide a lower body workout.

In other exercise configurations (e.g., FIG. 14), the seat 105 may be caused to swivel under tension, thus providing steady resistance for torso exercises and twisting movements performed by the user.

Figure 22:
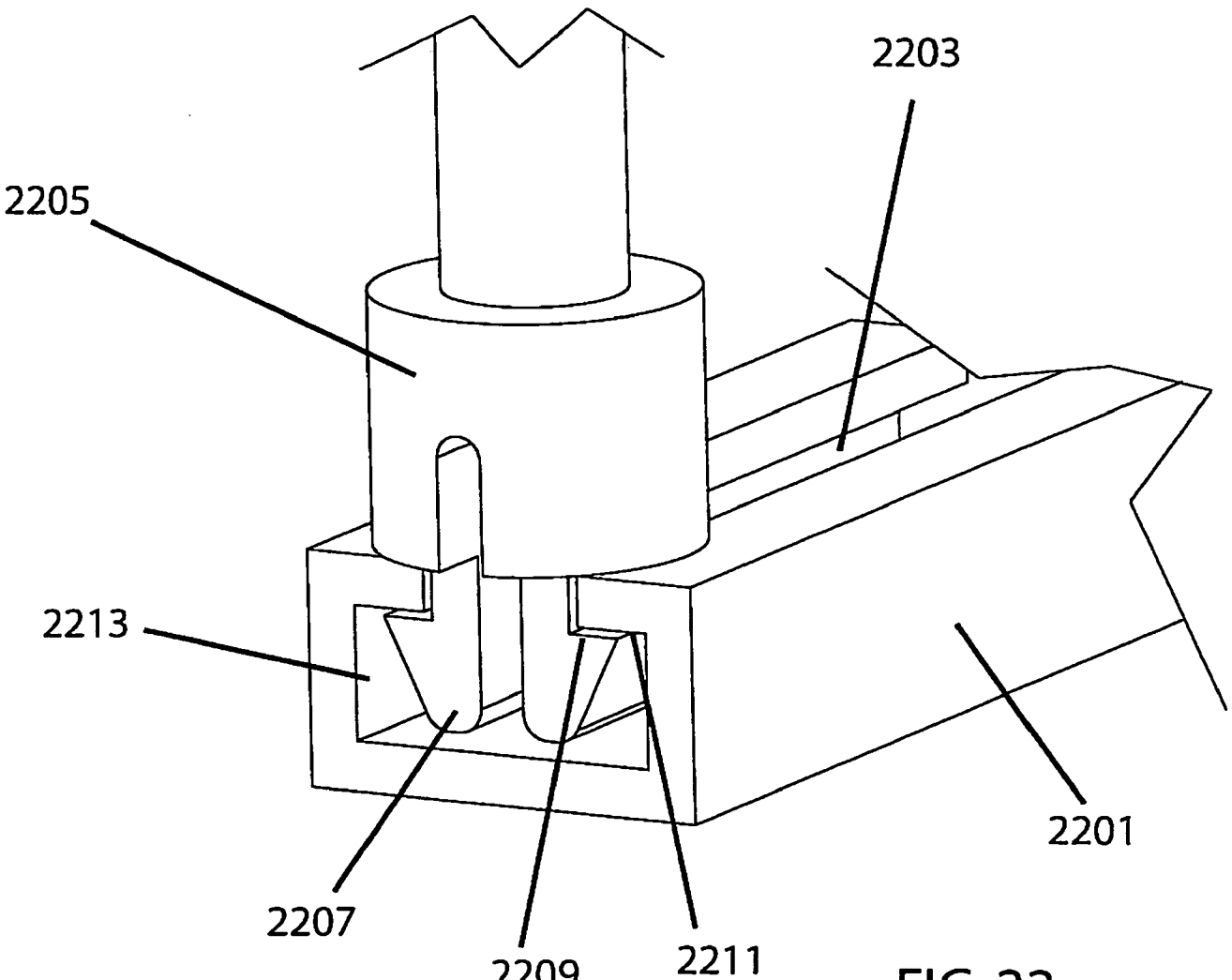
FIG. 22 depicts an exemplary front perspective cross-sectional view of an alternate embodiment for providing attachment points on a chair according to another aspect of the present invention.
Figure 23:
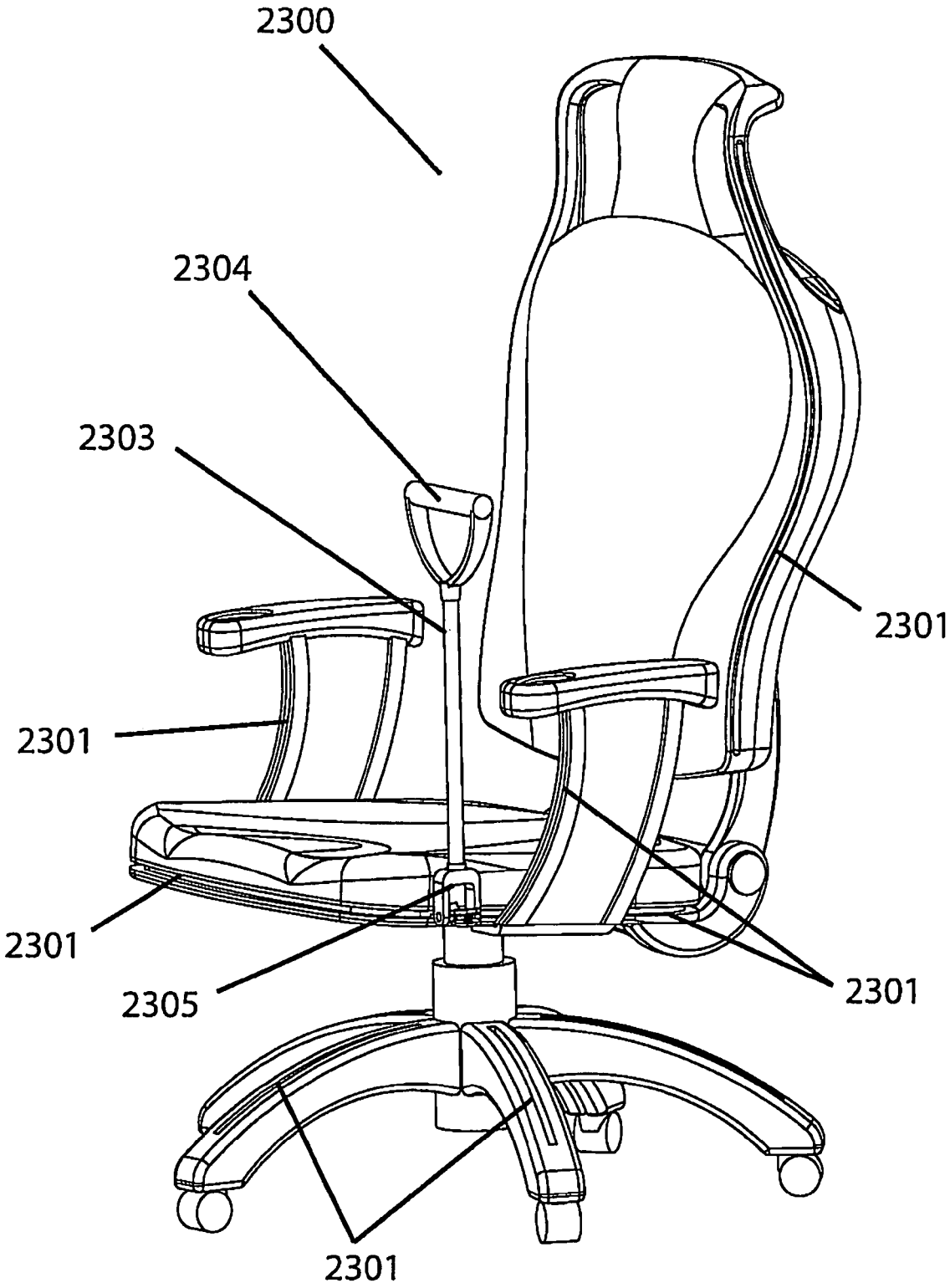
FIG. 23 is an exemplary front perspective view of an exercise chair having a resistance device attached to a seat according to an aspect of the present invention.
Figure 24:
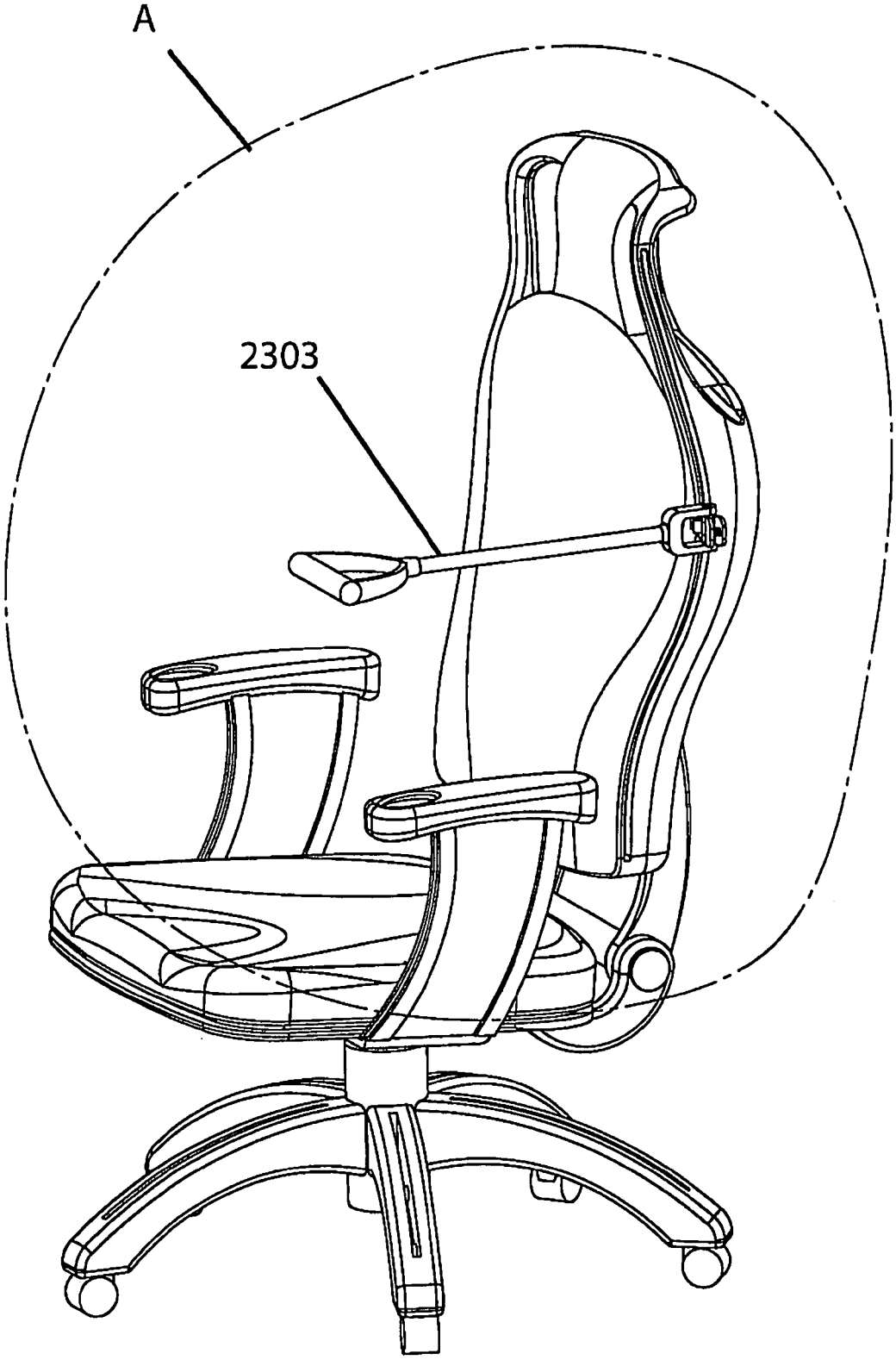
FIG. 24 is an exemplary front perspective view of an exercise chair having a resistance device attached to a back rest according to an aspect of the present invention.
Figure 25:
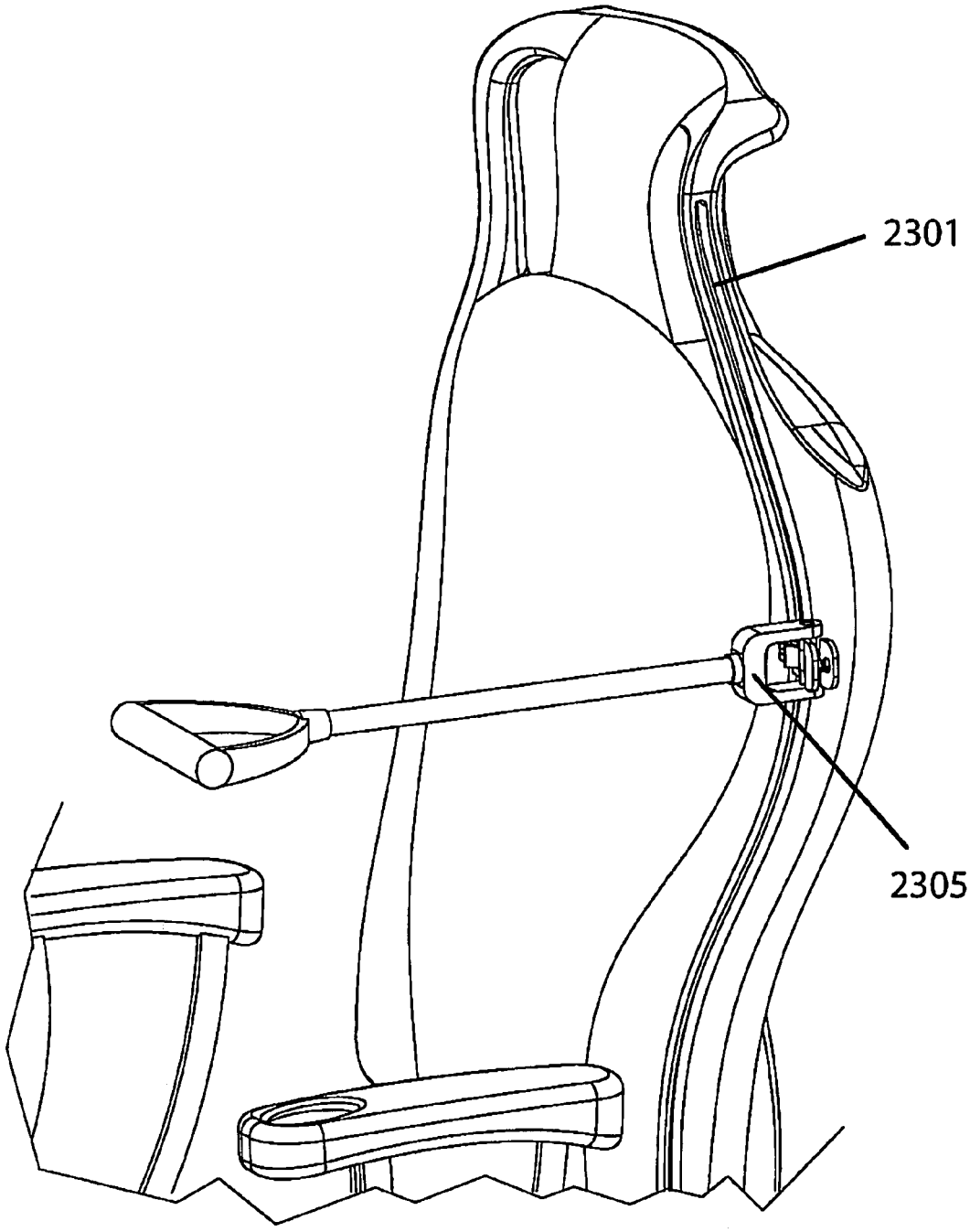
FIG. 25 is an exemplary enlarged view of area "A" in FIG. 24.
Figure 26:
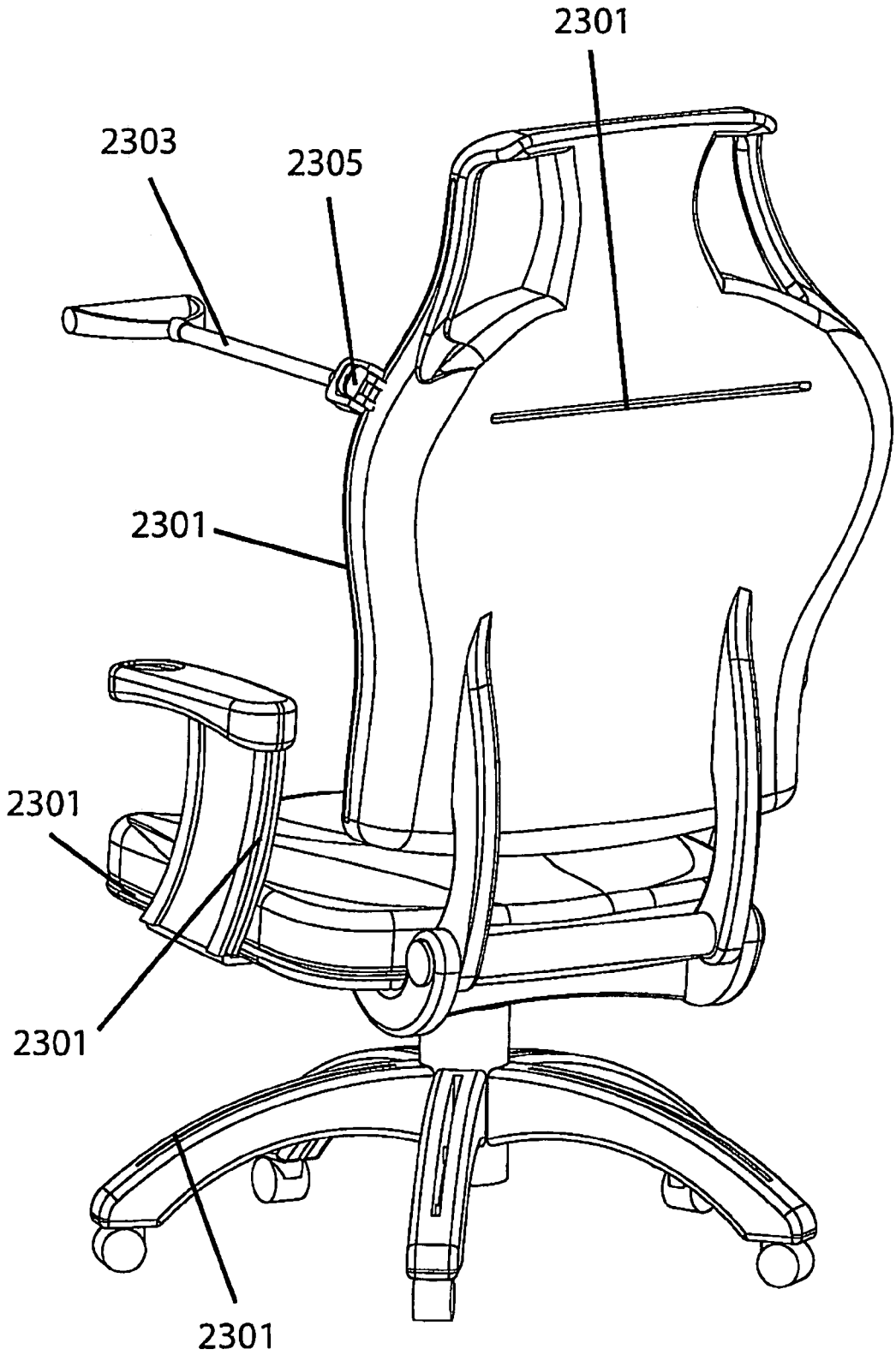
FIG. 26 is an exemplary rear perspective view of the chair of FIG. 24.
Figure 27:
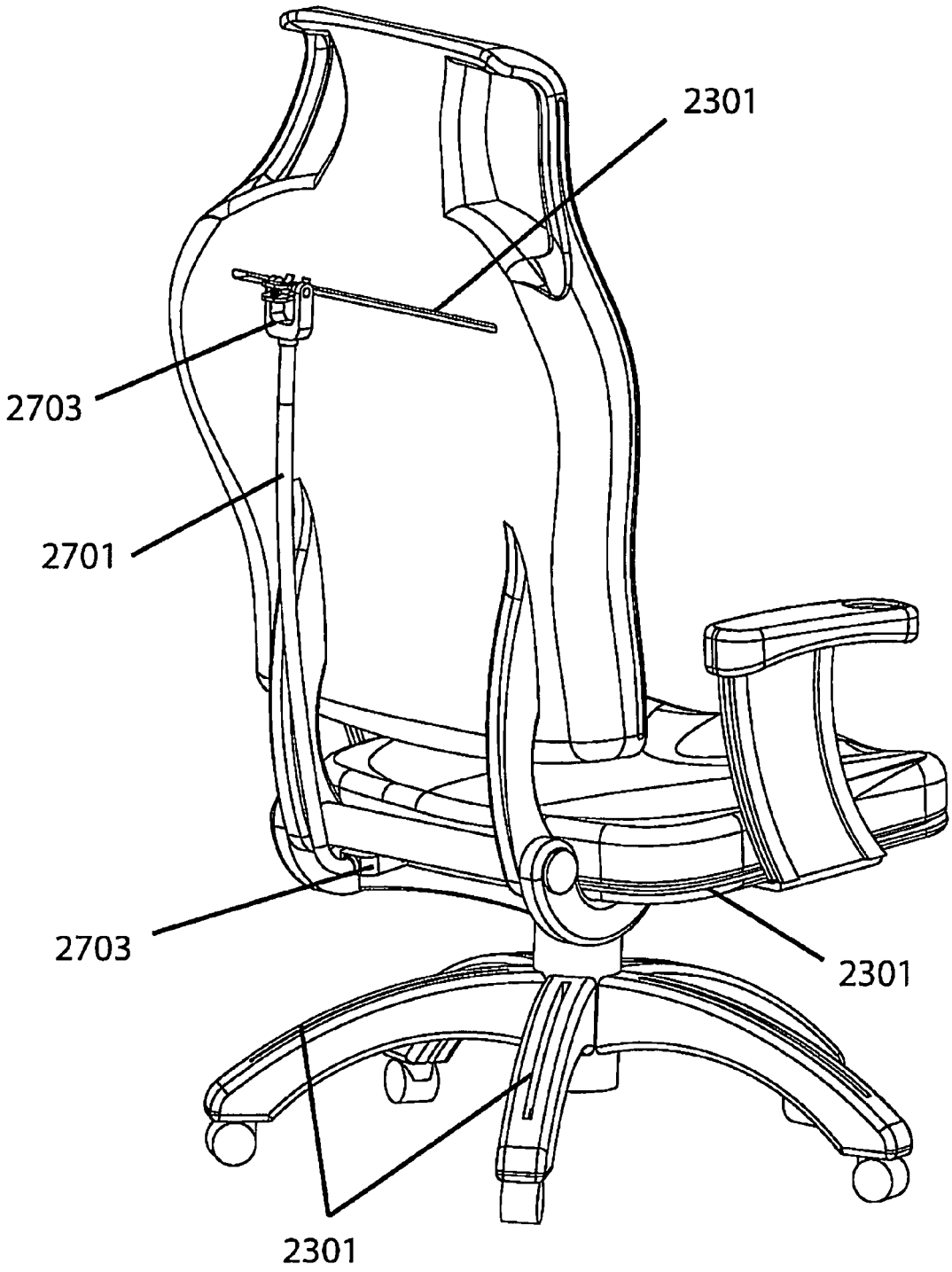
FIG. 27 is an exemplary rear perspective view of the chair of FIG. 24 having a resistance device attached thereon according to an aspect of the present invention.

FIG. 22 depicts a front perspective cross-sectional view of an alternate embodiment for providing attachment points on and coupling an exercise implement to the chair 100. A rail system 2201 may be provided on the chair 100, e.g., and contoured to run along the length of rear attachment members 201, arm attachment members 107, front and rear seat attachment members 113, 213, chair supports 109 and leg support 111. In one exemplary embodiment, the rail system 2201 may comprise a "T-slot;" that is, be substantially rectangular in cross-section with a hollow 2213 configured for receiving inserts 2207 of a coupling member 2205 of an exercise implement (not shown). Each insert 2207 may include a flange 2209 configured to be slidably receivable within hollow 2203. The inserts 2207 may be comprised of resilient or spring-loaded material that may be compressed to fit within slot 2203. Once received therein, the inserts 2207 spring back into their original shape, thus causing flange 2209 to be slidably secured against top lip 2211. The rail system 2201 may include a locking mechanism comprising a plurality of detents (not shown) at various intervals along rail 2201 to lock the coupling member 2205 in desired locations along the rail 2201.

FIGS. 23-28 are exemplary views of an exercise chair having an alternate attachment point system and resistance device(s) attached to same according to an aspect of the present invention. According to one embodiment, at least one track member 2301 is provided affixed on the chair 2300 comprising an elongate track preferably shaped to fit along contours of the chair. The track member 2301 may comprise a separate piece attached to the chair and/or be molded within the chair construction.

Preferably, a plurality of track members 2301 are provided throughout the chair 2300 to provide various attachment points thereon. For example, at least one track 2301 may be provided along each left and right side and rear of the back rest, along the perimeter of the seat, along the front and rear sides of each arm rest and along the tops of each chair leg support, e.g., as shown in FIG. 23-28.

Figure 28:
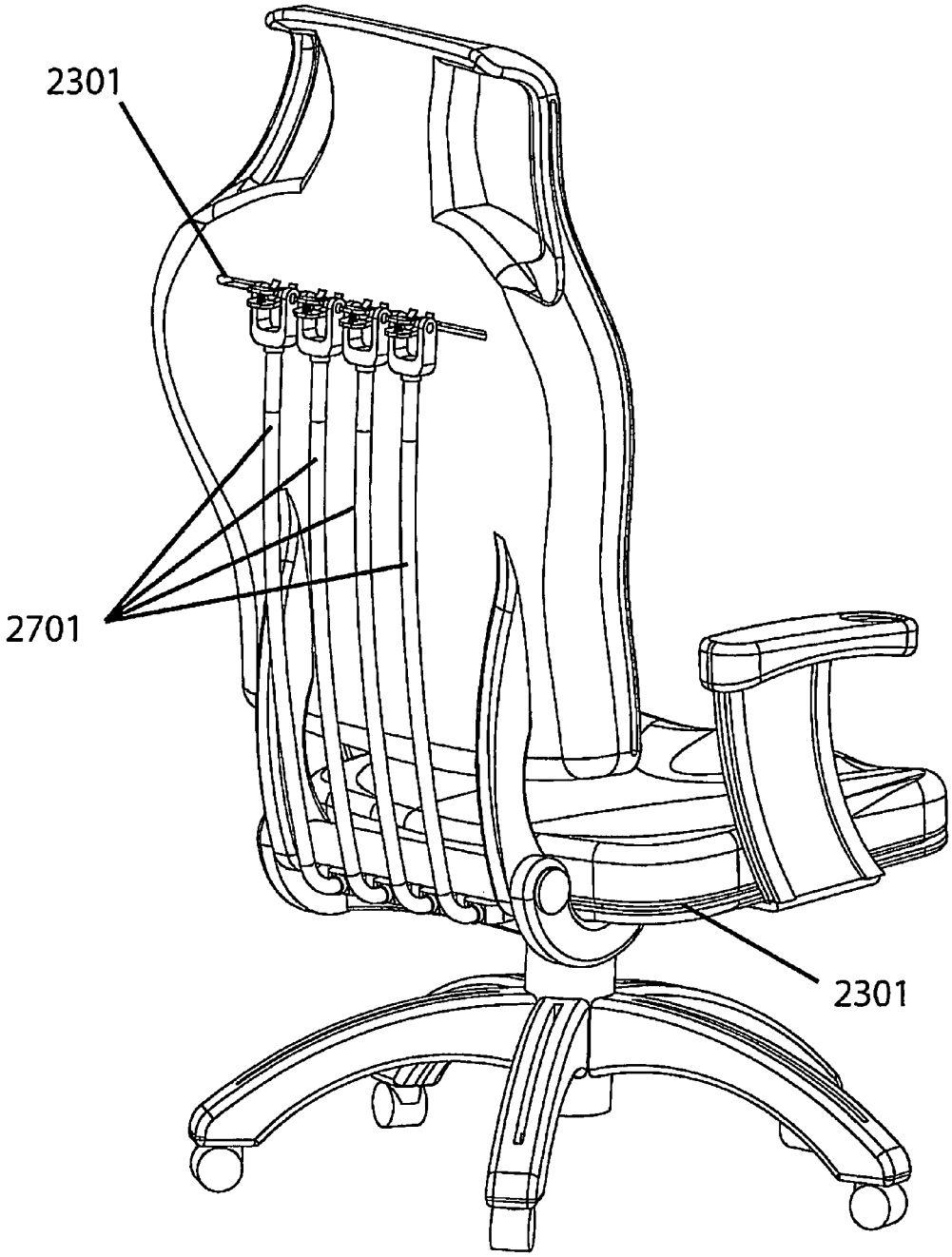
FIG. 28 is an exemplary rear perspective view of the chair of FIG. 24 having a plurality of resistance devices attached thereon according to an aspect of the present invention.
Figure 29:
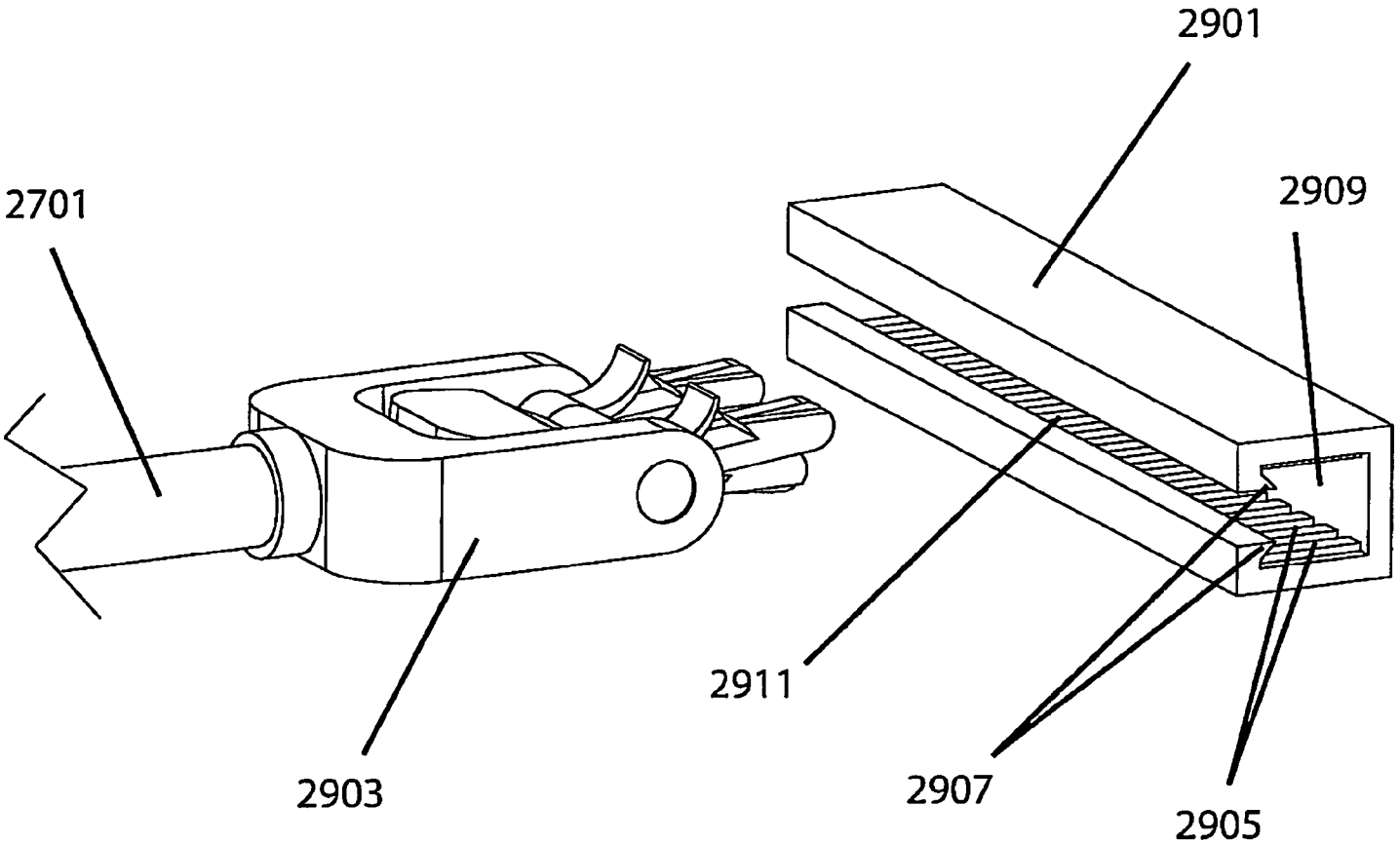
FIG. 29 is a front perspective view of an alternate coupling system according to an aspect of the present invention.
Figure 30:
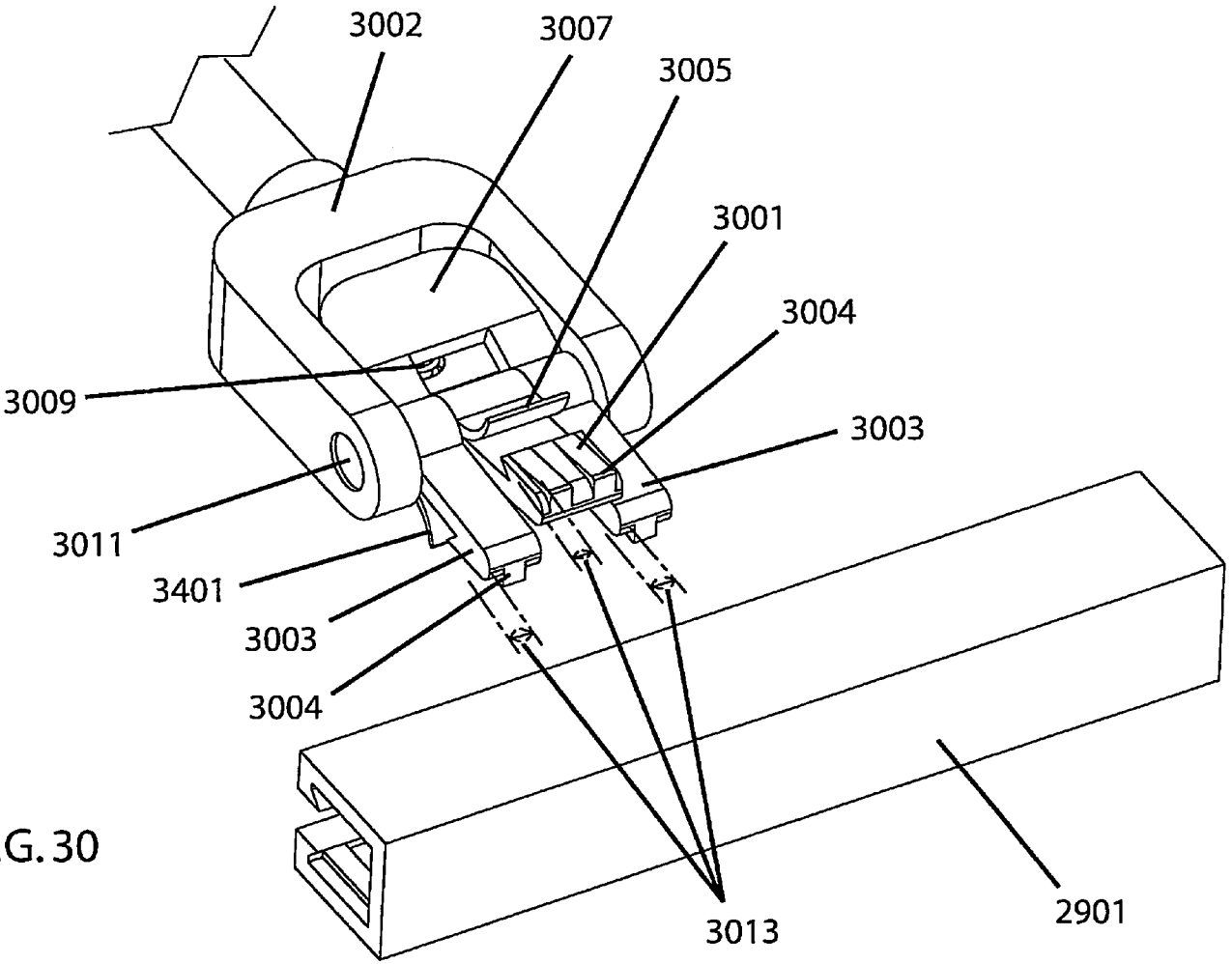
FIG. 30 is a rear perspective view of an alternate coupling system according to an aspect of the present invention.
Figure 31:
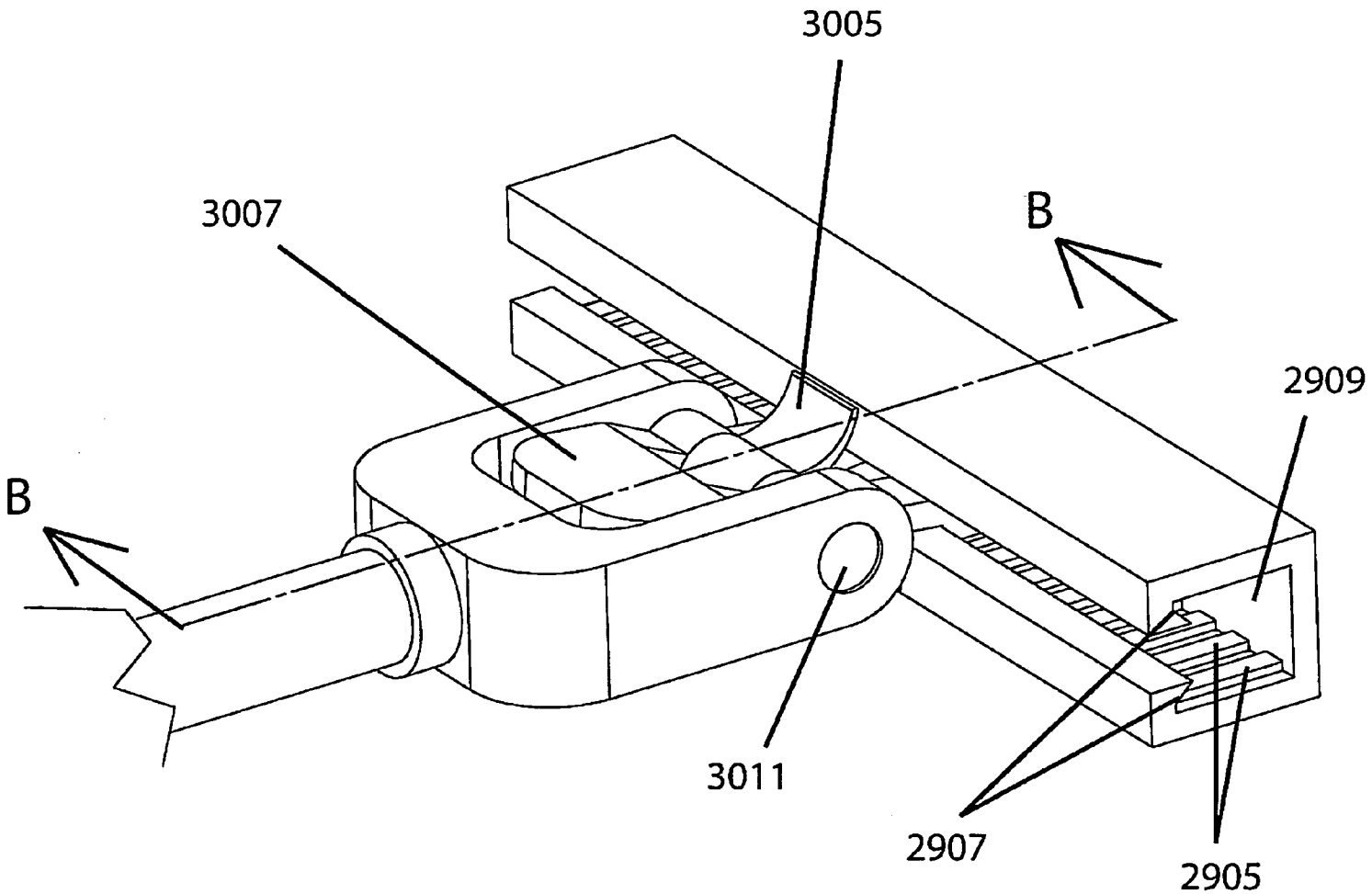
FIG. 31 is a front perspective view of an alternate coupling member coupled with an attachment member according to an aspect of the present invention.
Figure 32:
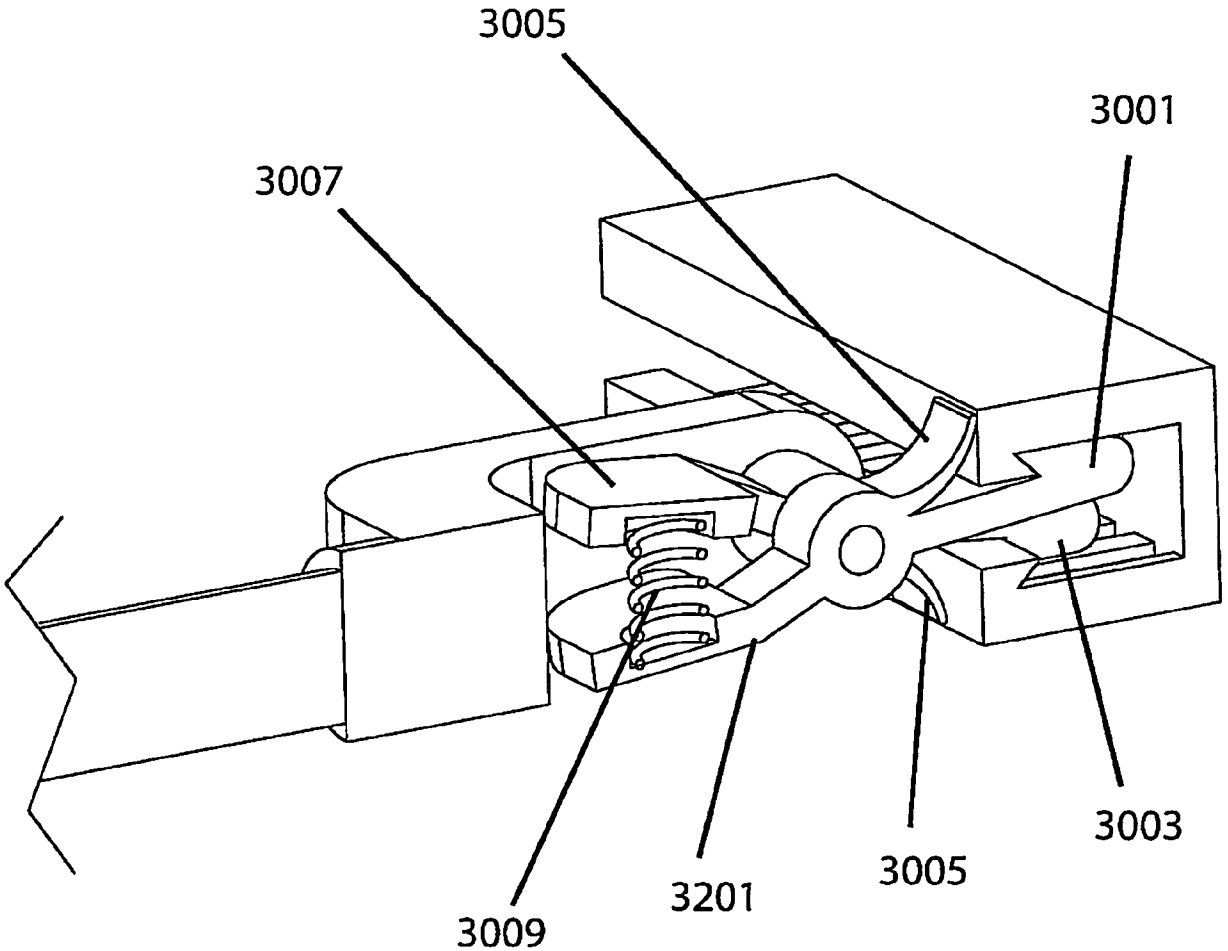
FIG. 32 is a perspective cross-sectional view taken along lines B-B of FIG. 31 according to an aspect of the present invention.
Figure 33:
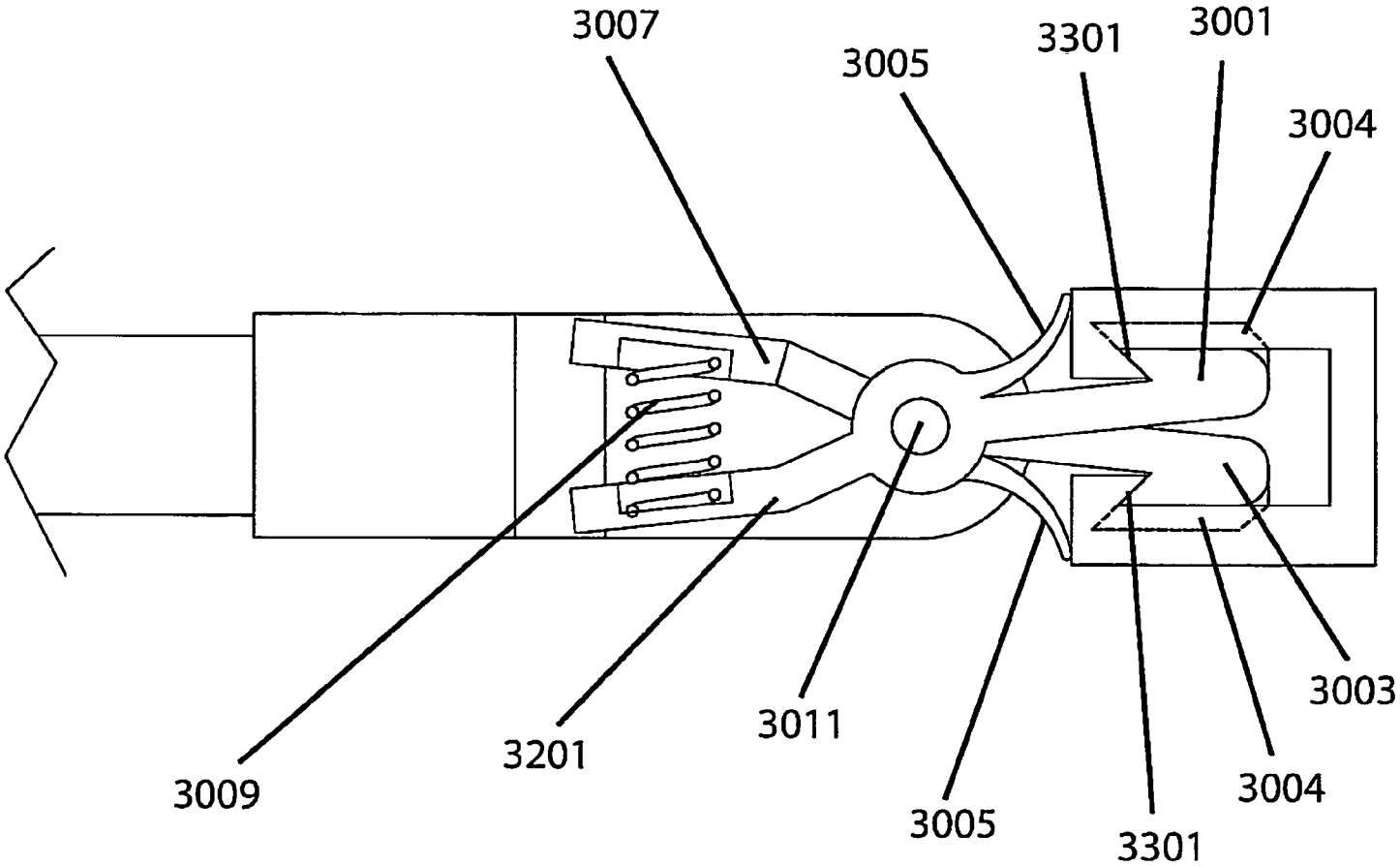
FIG. 33 is a front cross-sectional view taken along lines B-B of FIG. 31 according to an aspect of the present invention.

An exercise implement 2303 comprising e.g., a resistance band having a track coupling member 2305 at one end configured to be removably attached to at least one track member 2301 may be provided. The implement 2303 may include a handle 2304 at a second end. Alternatively, an exercise implement 2701 having a track coupling member 2703 at both ends may be provided. One or more exercise implements may be attached to the chair simultaneously in any position. For example, FIG. 28 depicts a plurality of exercise implements 2701 each having a first end coupled to a rear back rest track member 2301 and a rear edge of seat track member 2301.

FIGS. 29-34 are exemplary views of an alternate attachment system according to an aspect of the present invention. A track member 2901 may be provided comprising, e.g., a U-shaped body defining a cavity 2909 having a receiving slot 2911. A plurality of internal slots 2905 is disposed on at least one interior surface of the track member 2901. Any number of internal slots 2905 may be provided to effectuate a range of attachment points for exercise implements. At least one shaped lip 2907 (e.g., having a protrusion) is preferably provided on the track member 2901 and disposed adjacent to the receiving slot 2911.

A coupling member 2903 may be provided configured for removable and slidable attachment to the track member 2901. For example, in one embodiment, coupling member 2903 may comprise a U-shaped body 3002 having a spring-loaded member pivotally connected thereon. Spring-loaded member may comprise an upper plate 3007 connected to at least two side inserts 3003, and a lower plate 3201 connected to a center insert 3001. Each of the side inserts 3003 and center insert 3001 preferably includes at least one protrusion 3004 having a width 3013 sized and shaped to fit within the internal slots 2905. In addition, each of the side inserts 3003 and center insert 3001 preferably includes at least one protruding member 3301. At least one upper brace 3005 is provided affixed to the center insert 3001 and at least one lower brace 3401 is provided each affixed to each side insert 3003. The upper and lower braces 3005 are configured to stabilize the coupling member 2903 against an external wall of the track member during coupling (e.g., as shown in FIGS. 31-34).

The upper plate 3007 and lower plate 3201 are connected via tension coil 3009. Compression and expansion of the coil 3009 causes the plates 3007, 3201 and inserts 3003, 3001 to operate in a lever action, turning about fixed point 3011. For example, the upper plate 3007 and lower plate 3201 may be pressed together to compress the coil 3009, causing the center insert 3001 and side inserts 3003 to move towards each other into alignment, such that the center insert 3001 and side inserts are substantially aligned in side profile. This enables the center insert 3001 and side inserts 3003 to be inserted into/removed from the cavity 2909 of the track member 2901 via slot 2911 of the track member 2901.

Once inserted into the cavity 2909 of track member 2901, the spring loaded member may be freely slid within the track cavity 2909 so long as the upper and lower plates 3007, 3201 remain in the depressed position. When a desired location for securing of the exercise implement 2704 is reached, the upper and lower plates 3007, 3201 may be released, thus causing the center insert 3001 and side inserts 3003 to spring apart via expansion of the tension coil 3009, thereby inserting the protrusions 3004 into respective internal slots 2905 within the track member 2901. Further, protruding members 3301 are caused to be securely received within the shaped lip(s) 2907 of the track member 2901, and brace member 3005 are caused to be contacted on the exterior surface of the track member 2901. Accordingly, the coupling member 2903 is securely affixed within the desired location of track member 2901, being prevented from slidable movement within the track member 2901, and also being prevented from accidental dislodgement from same.

Figure 34:
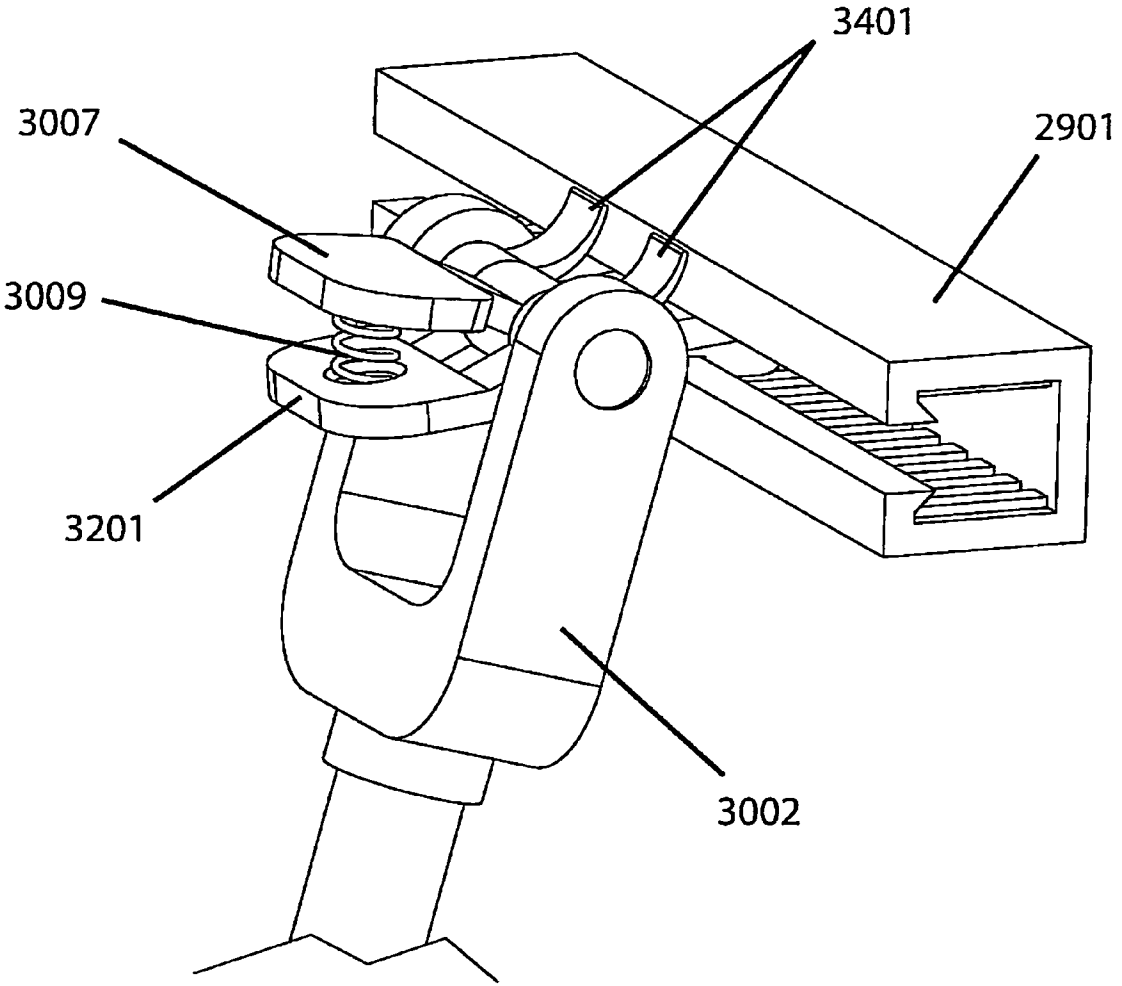
FIG. 34 is a front perspective view of an alternate coupling member coupled with an attachment member according to an aspect of the present invention.

As shown e.g., in FIG. 34, the body 3002 of the coupling may at least be pivotally connected to the center and side inserts 3001, 3003, thus allowing the exercise implement to be pivoted to various angles with respect to the point of attachment with the track member 2901.

An exercise chair system according to the present invention may be provided in the form of a kit, comprising a chair 100 and any combination, type and number of to the chair 100. Further, it is noted that the chair 100 exercise implements configured to be removably attachable itself may be provided preassembled or in kit form.

For each exercise implement, at least one resistance band may be provided. However, in an alternate embodiment, each exercise implement may be configured to have interchangeable resistance bands, and a plurality of resistance bands having various tension levels may be provided. Such removable attachment advantageously facilitates e.g., changing of resistance bands to different levels of resistance/length.

Preferably, at least rear attachment members 201, arm attachment members 107, front and rear seat attachment members 113, 213, chair supports 109 and leg support 111 are comprised of a lightweight but substantially rigid, rust-proof material, e.g., aluminum, which may be treated (e.g., anodized) for additional wear-resistance.

Advantageously, an exercise chair system according to the present invention boasts dual functionality as a comprehensive exercise apparatus while maintaining practical and ergonomic functions as a desk chair that may be used in an office or work environment. Practicing resistance exercises provided according to one aspect of the present invention strengthens and lengthens the muscle action, providing increased stability and power, while enhancing muscle integrity. Resistance is invoked via the elastic resistance bands, and in particular, the varied exercise configurations and customized leverage designations facilitated by the present invention assists in isolating and strengthening desired muscles/muscle groups of the user. Overall, the present invention provides exercise and stress-relief benefits, improves flexibility and maximizes convenience and portability.

Although the embodiment which incorporates the teachings of the present invention has been shown and described in detail herein, those skilled in the art can readily devise many other varied embodiments that still incorporate these teachings. Having described preferred embodiments for an exercise chair system (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

The invention claimed is:

1. An exercise apparatus comprising:

a mobile desk chair including a seat including at least two arm attachment members;

a back rest pivotally attached to the seat;

a base connected to the seat comprising a center post and a plurality of chair supports, wherein at least one of the back rest, seat, arm attachment members and chair supports includes at least one attachment point; and an exercise implement comprising a resilient resistance member removably attached to at least one of the attachment points, wherein each attachment point comprises a track member comprising a body defining a cavity having a receiving slot and a plurality of internal slots disposed therein.

2. The apparatus of claim 1, wherein at least one of the base and the plurality of chair supports is rotatable relative to the seat.

3. The apparatus of claim 1, wherein each chair support includes a swivel wheel to impart mobility to the desk chair.

4. The apparatus of claim 1, wherein the body of the track member includes at least one shaped lip adjacent to the receiving slot.

5. The apparatus of claim 1, wherein each arm attachment member further includes at least one arm rest void.

6. The apparatus of claim 1, further comprising an exercise implement removably attached to at least one of the attachment points.

7. The apparatus of claim 1, further comprising an exercise implement removably attached to at least one track member, the exercise implement including a coupling member configured to be received within the track member cavity.

8. The apparatus of claim 7, wherein the coupling member comprises a body having a spring-loaded member pivotally attached therein.

9. A mobile exercise desk chair comprising:

a back rest pivotally attached to a seat;

a base connected to the seat including a plurality of chair supports, wherein at least one of the back rest and at least one of the chair supports includes at least one attachment point; and at least one exercise implement comprising a resilient resistance member removably attached to at least one of the attachment points, wherein each attachment point comprises a track member including a cavity having a plurality of internal slots disposed therein.

10. The exercise chair of claim 9, further comprising at least one exercise implement having at least one coupling member removably attached to at least one of the attachment points.

11. The exercise chair of claim 10, wherein the exercise implement comprises a resistance band having at least one attachment coupling configured for removable attachment to at least one of said attachment points.

12. The exercise chair of claim 9, further comprising at least two arm attachment members affixed to the seat, each arm attachment member having at least one attachment point.

13. The exercise chair of claim 9, wherein each chair support includes a swivel wheel to impart mobility to the chair

14. A mobile exercise desk chair comprising:

a seat including at least two arm attachment members;

a back rest pivotally attached to the seat;

a base connected to the seat including a plurality of chair supports, wherein at least one of the arm attachment members, back rest and at least one of the chair supports includes at least one attachment point; and an exercise implement comprising a resilient resistance member having at least one end removably attached to at least one of the attachment points, wherein each attachment point comprises a track member including a cavity having a plurality of internal slots disposed therein.

15. The chair of claim 14, wherein each chair support includes a swivel wheel to impart mobility to the chair.

16. The chair of claim 14, wherein the exercise implement comprises a resistance band having an attachment coupling at each end, each coupling being configured for removable attachment to at least one of said attachment points.

* * * * *